US005281092A

United States Patent [19]

Sullivan

[11] Patent Number: 5,281,092

[45] Date of Patent: * Jan. 25, 1994

[54] VOLUTE HOUSING FOR A CENTRIFUGAL FAN, BLOWER OR THE LIKE

[76] Inventor: John T. Sullivan, 3910 Madison St., Hyattsville, Md. 20781

[ * ] Notice: The portion of the term of this patent subsequent to Aug. 25, 2009 has been disclaimed.

[21] Appl. No.: 967,029

[22] Filed: Oct. 27, 1992

Related U.S. Application Data

[60] Continuation-in-part of Ser. No. 893,512, Jun. 3, 1992, which is a division of Ser. No. 642,768, Jan. 18, 1991, Pat. No. 5,141,397.

[51] Int. Cl.[5] ..... F04D 29/42

[52] U.S. Cl. ..... 415/206; 415/214.1

[58] Field of Search ..... 415/182.1, 206, 214.1

[56] References Cited

U.S. PATENT DOCUMENTS

| | | | |
|---|---|---|---|
| 3,407,995 | 10/1968 | Kinsworthy | 415/206 |
| 3,491,550 | 1/1970 | Cavis | 62/285 |
| 3,856,431 | 12/1974 | Tucker | 415/206 |
| 3,874,191 | 4/1975 | Hudson | 415/206 |
| 4,026,624 | 5/1977 | Boag | 439/357 |
| 4,108,522 | 8/1978 | Favale | 439/357 |
| 4,448,573 | 5/1984 | Franz | 415/206 |
| 4,599,042 | 7/1986 | Colliver | 415/214.1 |
| 4,850,894 | 7/1989 | Michot | 439/357 |
| 4,915,643 | 4/1990 | Samejima et al. | 439/357 |
| 4,919,592 | 4/1990 | Sears et al. | 415/207 |
| 5,141,397 | 8/1992 | Sullivan | 415/206 |

FOREIGN PATENT DOCUMENTS

| | | | |
|---|---|---|---|
| 1305648 | 8/1962 | France | 415/206 |
| 145497 | 7/1985 | Japan | 415/206 |
| 275563 | 8/1951 | Switzerland | 415/207 |

OTHER PUBLICATIONS

Fan Engineering, 8th Edition, Pub. by Bufgalo Forge Co., Buffalo, N.Y.

Pump Handbook, Joseph P. Messina, 2nd Edition, Pub. McGraw-Hill Book Company.

Turboblowers by Alexey Joakim Stepanoff, New York, John Wiley & Sons, Inc.

*Primary Examiner*—John T. Kwon

*Attorney, Agent, or Firm*—Diller, Ramik & Wight

[57] ABSTRACT

A volute housing for a centrifugal fan, blower or the like includes a housing body defined by opposite spaced sidewalls with a generally circular fluid inlet opening in each sidewall and a volute peripheral wall disposed between the sidewalls and defining therewith a volute chamber. The sidewalls each have a first sidewall portion extending arcuately from a first zone of minimum radial dimension at a tongue of the volute chamber in the range of between 25 degrees to 320 degrees to a transition zone, and sidewall portions diverge progressively axially outwardly between the first zone and the transition zone to effect optimal fluid flow.

65 Claims, 10 Drawing Sheets

101
103
F
R1
R2
104
102
F
R
C
100
100
17
15
16
46
46
45
45
73
41
51
R
62
61
41
13
16
15
73
15
17
11
10

13
10
79
89
14
89
12
11
79
61
62
41
R
A
42
51
52
75
76
100
74
79
89
77
78
73
75'
81
42
61
62
76'
41
R1
100
R
100
R2

10
11
13
14
15
16
17
21
22
23
24
25
26
30
31
32
33
34
35
41
42
44
45
46
60
61
62
72
73
74
80
81
100
A
B
R
T
0°
180°
360°

VOLUTE HOUSING FOR A CENTRIFUGAL FAN, BLOWER OR THE LIKE

CROSS-REFERENCE TO RELATED APPLICATION

This application is a continuation-in-part application of Ser. No. 07/893,512 filed on Jun. 3, 1992 which is in turn a divisional application of Ser. No. 07/642,768 filed on Jan. 18, 1991 and now U.S. Pat. No. 5,141,397 issued on Aug. 25, 1992.

BACKGROUND OF THE INVENTION

This invention is directed to a volute housing for a centrifugal fan, blower or the like. The theory, design and application of such centrifugal fans can be found in the publications entitled "Turboblowers" by Alexey Joakim Stepanoff, published by John Wiley & Sons, Inc. and available at the Library of the University of Maryland, College Park, Md. and "Fan Engineering" by Richard D. Madison, published by Buffalo Forge Company, Buffalo, N.Y. (copyright 1949) and also available at the latter noted library. These publications describe several volute housing designs, including a constant velocity volute which is said to be the most favorable for efficiency because of the alleged fact that at the best efficiency point pressure is uniform around the volute. The latter condition is said to be the most desirable for impeller performance. In this design the entire recovery of the kinetic energy into pressure takes place in the volute nozzle which is preferably of a diverging relationship with the included angle being established experimentally at 8° for a circular cone to obtain the most efficient velocity convergent through the nozzle, though a range of 6° to 10° is acceptable. Beyond 10° efficiency is adversely affected. However, in such constant velocity volute housings, the volute pressure is constant until released by the discharge nozzle. The disadvantage of such constant velocity volute housings is that the capacity must be maintained at all times at its rated capacity, otherwise at partial capacities, pressure increases toward larger volute sections and decreases toward smaller volute sections. This decreases efficiency and increases noise.

In an abbreviated volute housing about one-quarter of the impeller periphery discharges directly into the discharge opening without establishing normal volute pressure and velocity distribution prevailing in the remaining three-quarters of the controlled volute housing section. The disadvantage is that the average volute velocity may only be one-half of the absolute velocity at the impeller discharge. Thus sound is decreased but so too is efficiency.

In both the normal volute casing and the abbreviated volute casing, the sidewalls are substantially parallel to each other throughout and it is the peripheral volute wall which progressively diverges from the circular fluid inlet openings in a direction away from the cut-off point or tongue to the volute throat. Essentially, the volute peripheral wall ends at the volute throat and the volute throat defines the initiation or entrance of the discharge nozzle. It is in the area downstream of the throat that the discharge nozzle sidewalls are flared in a direction diverging away from each other in the direction of fluid travel. Such flaring can extend slightly downstream of the volute throat. Such volute casings or housings are generally constructed from galvanized metal and the divergent sidewall angles are extremely abrupt (20°–45°) resulting in excessive turbulence and swirling of discharge fluid/air with an attendant increase in noise.

Another volute housing includes typical circular fluid inlet openings, a volute peripheral wall and sidewalls which continuously diverge from the cut-off point or tongue in the direction of fluid flow to the throat and beyond the discharge nozzle to the discharge opening or orifice. A volute housing so constructed is found in U.S. Pat. No. 3,491,550 in the name of Thomas C. Cavis issued Jan. 27, 1970. This construction increases the RPM's only, and effects expansion from the throat or cut-off point through 360° which basically creates a sound amplification structure typical of the curvature found in a tuba or a french horn. This creates a low bass hum which amplifies the highest sound at the compression point or tongue which is the area of maximum (and virtually only) compression.

From the foregoing, each of the volute housings known suffer from two main disadvantages, namely, (a) low efficiency and (b) high noise.

SUMMARY OF THE INVENTION

In keeping with the foregoing, a primary object of the present invention is to provide a novel volute housing which is (a) highly efficient and (b) quiet.

The novel volute housing of the present invention includes a housing body defined by opposite spaced sidewalls, a generally circular fluid inlet opening in each sidewall with the fluid inlet openings having a coincident axis and a volute peripheral wall disposed between the sidewalls. The sidewalls each have a generally minimum radial dimension located at a first zone (throat/cut-off area) which progressively increases to a maximum radial dimension located at a second zone (volute throat). The arcuate distance between these first and second zones is generally 360°, and to this extent the volute housing just described constitutes a normal volute housing. However, in keeping with this invention the sidewalls each have first and second sidewall portions with a first sidewall portion of each sidewall extending arcuately from the first zone (cut-off point/tongue) generally 180° to a transition zone, and over this arcuate extent the first sidewall portions are generally parallel to each other. The sidewalls also have second sidewall portions which extend arcuately from the transition zone to the volute throat, and in keeping with the invention, the second sidewall portions are in diverging relationship in a direction away from the transition zone to the volute throat whereby fluid flowing through the housing body in a direction from the transition zone toward the throat expands progressively axially outwardly as it flows between and along the second sidewall portions. This construction increases the efficiency of the volute housing and appreciably lessens sound/noise.

In further accordance with the present invention the housing body is preferably constructed from a pair of housing parts joined to each other along a radial plane generally normal to the coincident axis and between the sidewalls. Thus, the two housing parts can be rapidly interconnected to each other, preferably by cooperative male and female fasteners.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 6(*a*), 6(*b*) and 6(*c*) are the exploded fragmentary cross sectional view of one of several pairs of male and female fasteners, and illustrates the progressive sequence for snap-securing the same to each other.

DESCRIPTION OF THE PREFERRED EMBODIMENT

Figure 1:
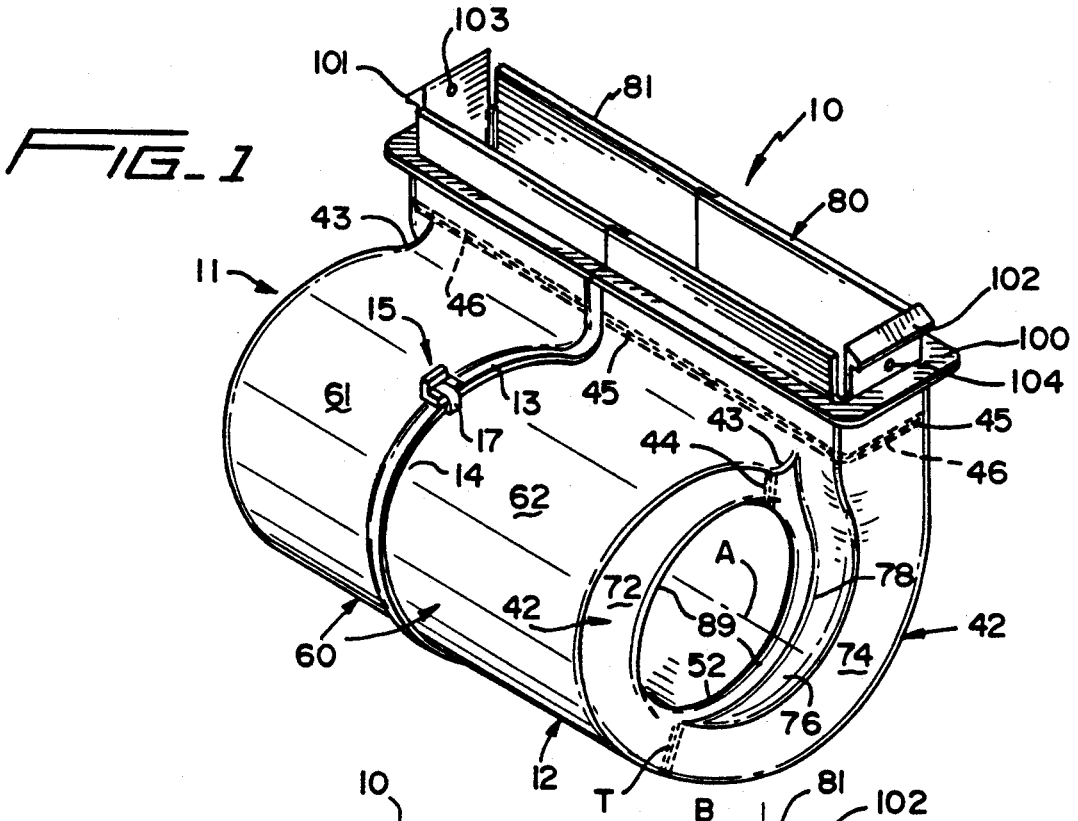
FIG. 1 is a perspective view of a novel volute housing constructed in accordance with this invention particularly adapted for utilization with a centrifugal fan, blower or the like, and illustrates a volute peripheral wall, a pair of sidewalls associated therewith, circular fluid inlet openings associated with each sidewall, and a sidewall portion which diverges progressively axially outwardly and in the direction of fluid flow between a transition zone (180°) and a volute throat (generally 360°).

A volute housing for a centrifugal fan, blower or the like is best illustrated in FIGS. 1-5 of the drawings and is generally designated by the reference numeral 10.

The volute housing 10 includes a housing body defined by a pair of housing parts or halves 11, 12. The housing parts 11, 12 are joined to each other along a generally radial plane R (FIGS. 3 through 5) through interlocked edges 13, 14 (FIGS. 3 and 4).

Figure 7:
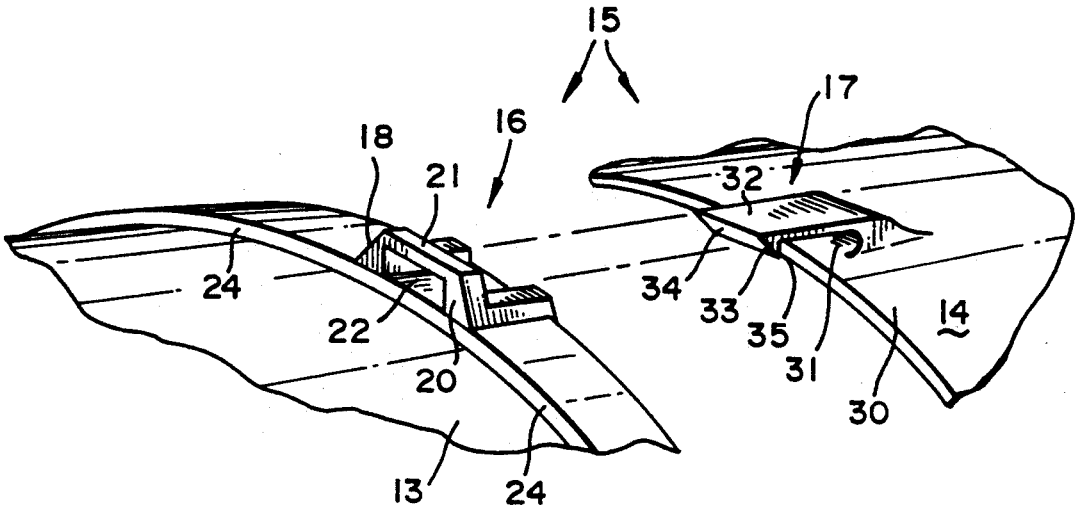
FIG. 7 is a fragmentary perspective view of two housing body parts of the volute housing body, and illustrates the axial alignment of a male and female fastener prior to securing the same to each other.
Figure 8:
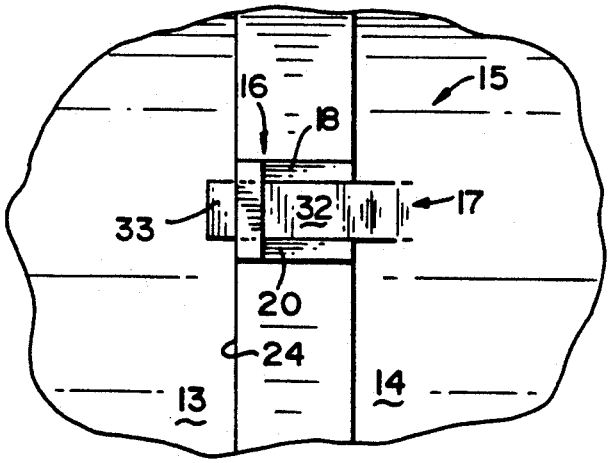
FIG. 8 is a reduced fragmentary elevational view of the snap fasteners of FIG. 7 and illustrates the male and female snap fasteners in assembled snap-secured relationship to each other.

The edges 13, 14 carry pairs of fasteners 15 defined by female fasteners 16 carried by the edge 13 and male fasteners 17 carried by the edge 14 (FIGS. 2, 3, 6-8). The female fasteners 16 include a pair of radially projecting spaced legs 18, 20 (FIG. 2) spanned by a bridge 21 and collectively defining a female opening 22. An undersurface 23 of the bridge 21 is curved to define a converging entrance (unnumbered) of the female opening 22. To the left and below each female opening 22, as viewed in FIGS. 6 and 7, is a ledge 24. Projecting to the right of the ledge 24, again as viewed in FIGS. 6 and 7, is an offset projection or nose 25 defining a terminal end of the edge 13 and a generally internal peripheral recess 26 thereof. A terminal end 30 of the edge 14 (FIGS. 6 and 7) is spaced by a gap or space 31 from a tongue or projection 32 ending in a radially inwardly directed locking lip 33. The locking lip 33 has an angled entrance surface 34 and a locking surface 35 which lies in a plane generally normal to an axis A (FIG. 2) of the volute housing parts 11, 12 and generally circular fluid inlet openings 51, 52 in respective sidewalls 41, 42 (FIGS. 1–4). The width of the tongue 17 corresponds to the width of the female opening 22 (see FIG. 8) and the thickness of the nose 25 corresponds to the radial width of the gap 31.

Figure 2:
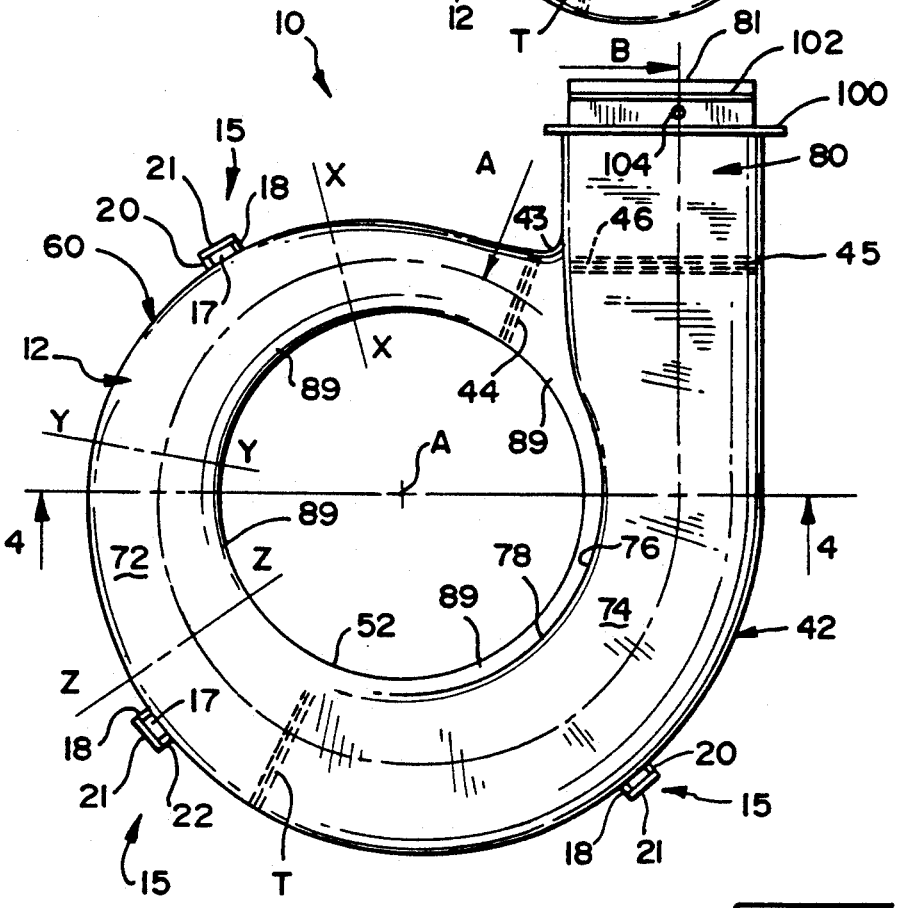
FIG. 2 is an enlarged side elevational view of the volute housing of FIG. 1, and illustrates structural details of the volute housing.
Figure 3:
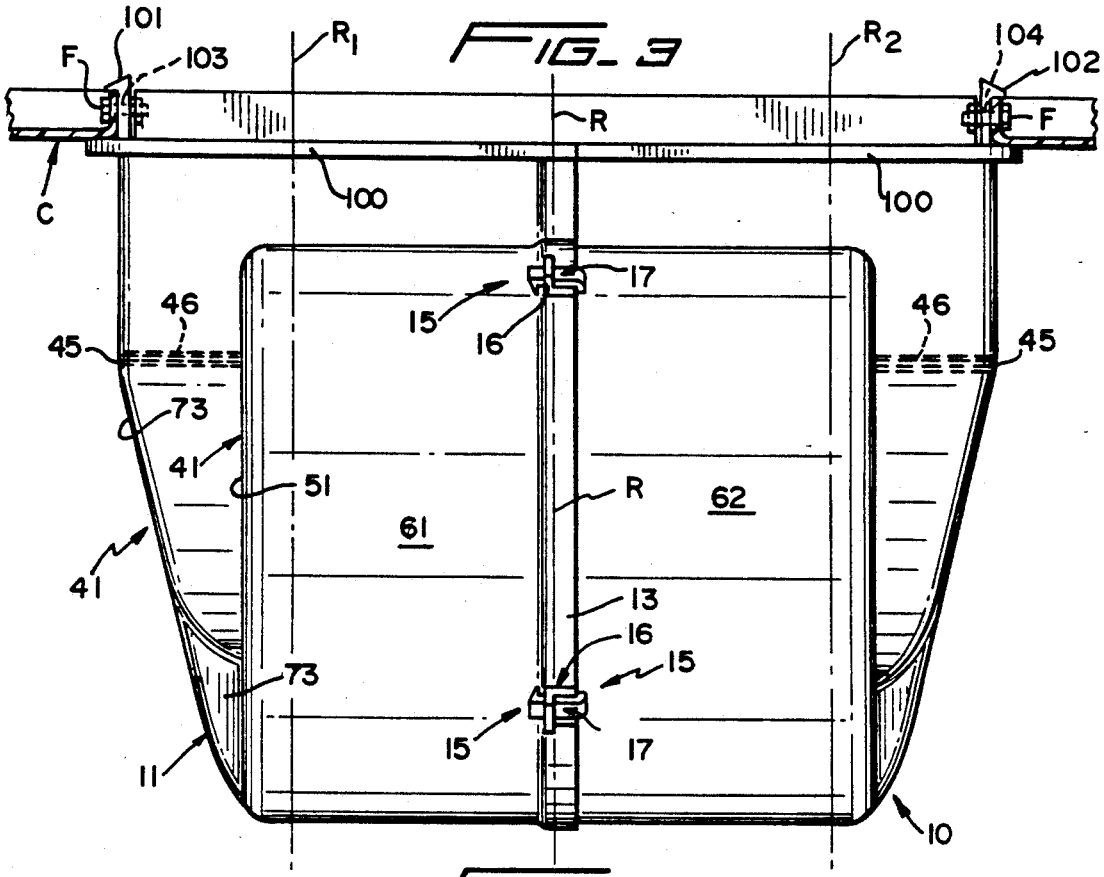
FIG. 3 is an enlarged perspective view of the volute housing of FIGS. 1 and 2, and illustrates the construction thereof from two housing parts snapped together by male and female fasteners with the volute housing being snap-secured in an opening of a convector tray or pan of a fan coil unit.
Figure 4:
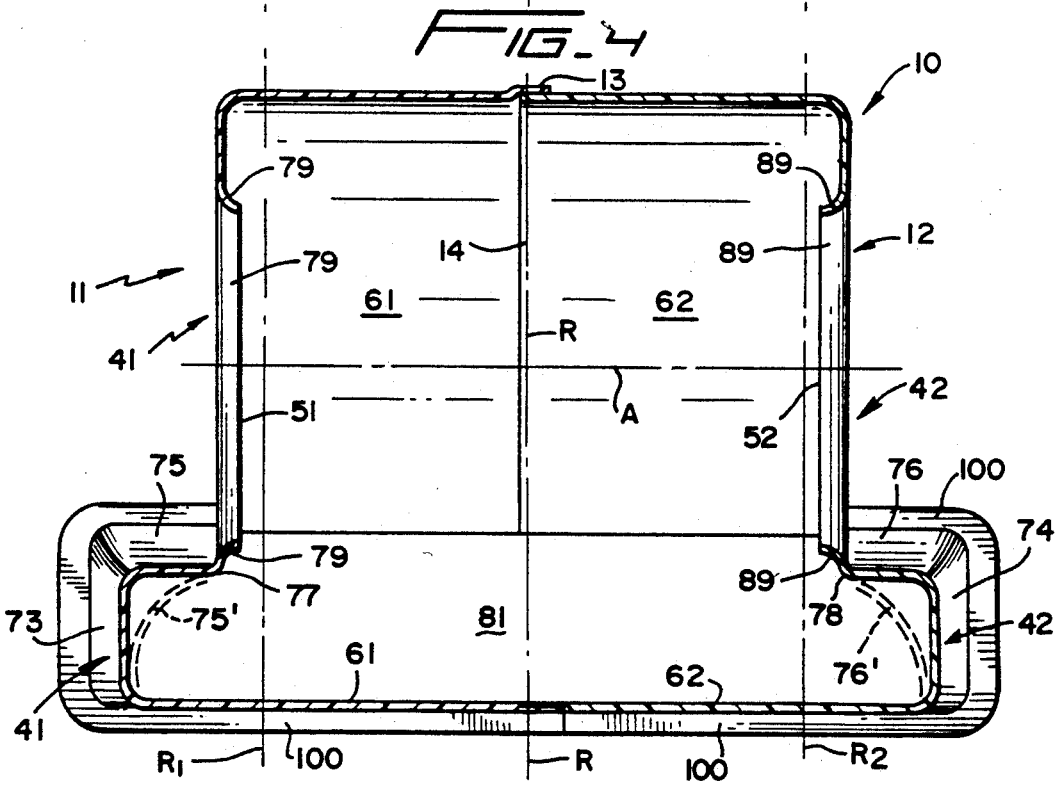
FIG. 4 is an enlarged cross sectional view taken generally along line 4—4 of FIG. 2, and illustrates the manner in which the sidewall portions of the volute housing body between approximately 180° and 360° diverge in a direction away from each other relative to the direction of fluid travel and toward the discharge nozzle opening.

In order to assemble the housing parts 11, 12 into the volute housing 10 to the configuration shown in FIGS. 1 through 3, the two halves 11, 12 are aligned with each other with each of the tongues 32 aligned with an associated female opening 22 in the manner shown in FIG. 6 (left-hand-most illustration). The two halves 11, 12 are then moved toward each other at which time the surface 34 moves along the nose 25 and is deflected slightly upwardly thereby eventually contacting the divergent portion (unnumbered) of the undersurface 23 of the bridge 21 as the nose 25 moves into the gap 31 (FIG. 6, center illustration). In this fashion the bridge 21 prevents the tongue 32 from being deflected excessively upwardly, and when finally mated, the inherent resilience of the tongue 32 causes the same to rebound to the right-hand-most position shown in FIG. 6 at which time the locking surface 35 abuts against the ledge 24. In order to unlock the housing parts 11, 12 and disassemble the volute housing 10, the tongues 32 are deflected upwardly sufficiently for the surfaces 35 to clear the ledges 24 which is controlled by the undersurface 23 of the bridge 21. The bridge 21 also prevents each tongue 32 from being deflected excessively and being broken during the disengagement of the surfaces 35 from the ledges 24. Once the latter disengagement occurs, the housing parts 11, 12 can be simply pulled apart to disassemble the same.

The volute housing 10 includes a volute peripheral wall 60 defined by a volute peripheral wall portion 61 of the volute housing half or part 11 and a volute peripheral wall portion 62 of the volute housing part 12. The volute peripheral wall 60 extends generally from a volute tongue or cut-off 43 which is located generally at a first zone 44 of minimum radial dimension or distance relative to the openings 51, 52 to a second zone 45 located at a volute throat 46. The direction of fluid flow is counterclockwise relative to the volute peripheral wall 60, as viewed in FIG. 2, and as is best illustrated in FIG. 2, the sidewall 42 progressively increases in radial size in the direction of fluid travel from the first zone 44 of minimum radial dimension to the second zone 45 of maximum radial dimension. The arcuate distance between the first zone 44 and the volute tongue or cut-off point 43 and the second zone 45 or volute throat 46 in the direction of fluid flow is generally 360° (FIGS. 2 and 6).

Figures 5, 6A, 6B, 6C:
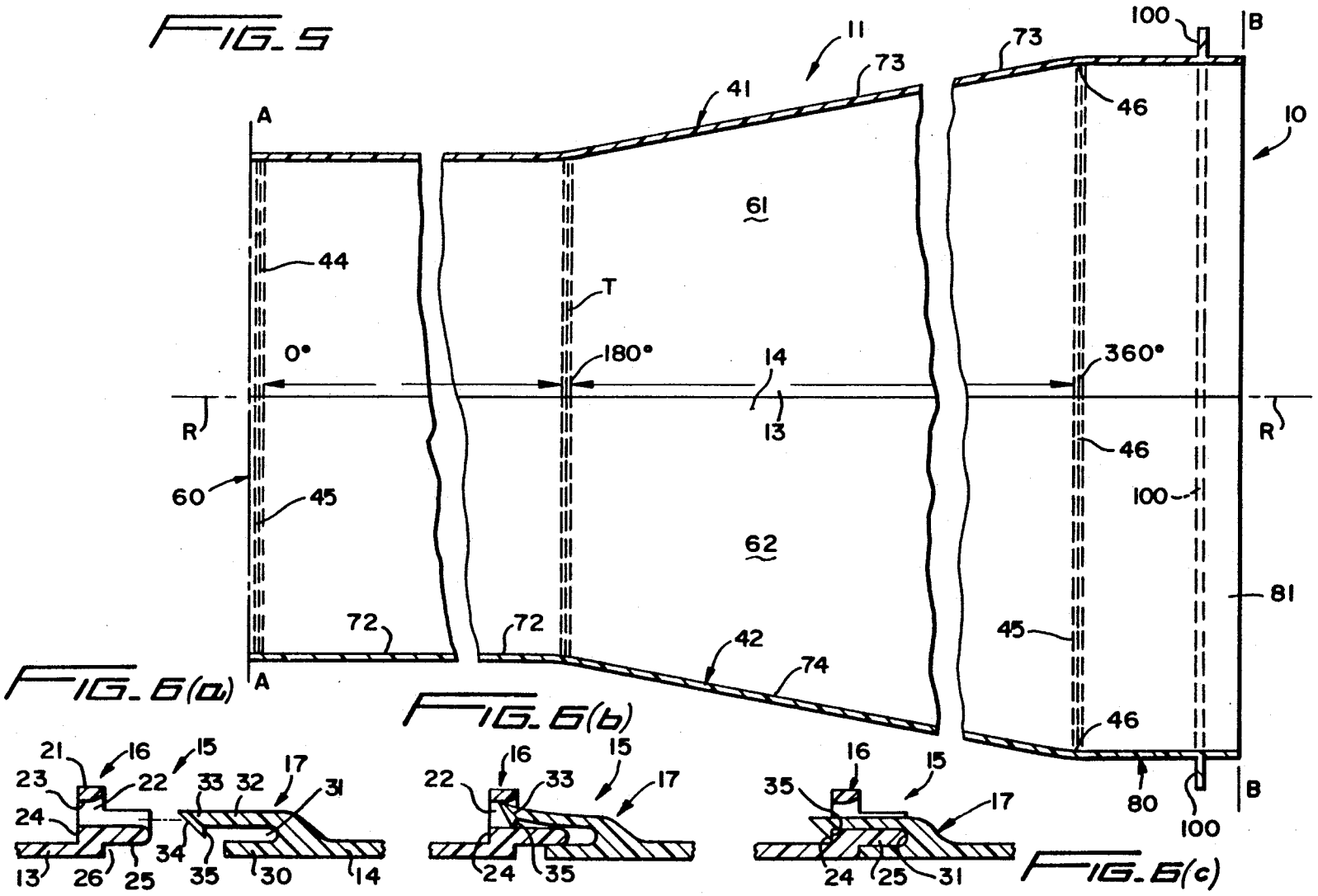
FIG. 5 is a cross sectional view taken generally along the line A-B of FIG. 2 and laid out in a flat plane, and illustrates the generally parallel relationship of a first pair of sidewall portions between a tongue or cut-off point (0°) and a transition zone 180° removed, and the divergent relationship of a pair of second sidewall portions between the transition zone (180°) and another zone (throat) 360° from the cut-off point/tongue.

Each of the sidewalls 41, 42 includes respective first sidewall portions 71, 72 and second sidewall portions 73, 74. The first sidewall portions 71, 72 are in generally parallel relationship to each other (FIG. 5) and extend approximately 180° from the first zone 44 to a transition zone T (FIGS. 2 and 5). As viewed in FIGS. 2 and 5, the transition zone T is located approximately 180° from the first zone 44 and tongue 43, as measured counterclockwise in FIG. 2. Thus, fluid/air flow between generally the tongue or cut-off 43 and the first zone 44 up to the transition zone T will be confined radially against expansion by the generally parallel sidewall portions 71, 72. After the transition zone T and up to the second zone 45/volute throat 46, the second wall portions 73, 74 diverge away from each other in the direction of fluid flow, as is best illustrated in FIG. 5. Thus, the fluid/air travelling from the transition zone T to the volute throat 46/second zone 45 will expand radially outwardly eventually exiting through a generally polygonal discharge nozzle 80 having a discharge opening 81. The cross sectional configuration at the volute throat 46 corresponds to the cross sectional configuration of the discharge opening 81 of the discharge nozzle 80, and thus between the volute throat 46 and the discharge opening 81, no further expansion of the fluid/air takes place.

Axial transition walls 75, 76 (FIGS. 1 through 4) bridge between the respective openings 51, 52 and the second sidewall portions 73, 74, respectively, of the sidewalls 41, 42, respectively. The axial transition walls 75, 76 merge very abruptly with the respective second sidewall portions 73, 74 at sharp radii or radius portions 77, 78, respectively (FIGS. 1, 2 and 4). The radii 77, 78 are relatively abrupt (FIG. 4) and merge with less abrupt radii or radius portions 79, 89, respectively (FIGS. 1, 2 and 4). The axial transition walls 75, 76 and the respective radii 77, 78 begin at the transition zone T and progressively widen radially (see FIG. 1) to the volute throat 46/second zone 45. While the abrupt radii 77, 78 extend generally only between the transition zone T to the volute throat 46/second zone 45, the less abrupt radii 79, 89 extend a full 360° about the respective openings 51, 52 (FIGS. 1 and 4). Because of the latter construction a continuous uniform circumferential inlet cap is formed between an impeller (not shown) associated with the volute housing 10 and the gradual radii 79, 89 thereof. This causes uniform circumferential air flow into the volute housing 10 which balances not only the air flow, but in turn balances the torque on the impeller, its shaft and the associated drive motor (not shown) resulting in minimal vibration. The transition walls 75, 76 are generally in parallel relationship to the portions of the volute peripheral wall portions 61, 62 radially opposite thereto. Accordingly, as fluid/air flows between the transition zone T and the volute throat 46/second zone 45, the fluid/air can expand radially outwardly because of the divergent nature of the second wall portions 73, 74 but is constrained against radial expansion until reaching the volute throat 46/second zone 45.

From the foregoing, the radial cross section through the first zone 44 defines the minimum cross sectional volume of the volute fluid chamber (unnumbered) with, of course, the fluid chamber being established generally as that volume between the volute peripheral wall 60 and the inlet openings 51, 52 or the outer periphery of an impeller (not shown) mounted in the volute housing 10. This cross sectional volume progressively increases in the direction of fluid/air flow as, for example, in the direction of selected radial planes X—X, Y—Y, Z—Z, etc. until reaching a maximum at the transition zone T. However, during the enlargement of the volumes between generally 0° and 180°, all of the enlargement of chamber volume is through radial expansion and not through axial expansion because of the generally parallel relationship of the first sidewall portions 71, 72 of the respective sidewalls 41, 42. However, the cross sectional volume of the air/fluid chamber beginning at the transition zone T progressively increases toward the second zone 45/volute throat 46, not only radially but also axially, because of the progressive divergence of the second sidewall portions 73, 74 toward and to the volute throat 46/second zone 45. At the latter zone the cross sectional volume remains generally unchanged as it passes through the discharge nozzle 80 exiting the discharge opening 81 thereof. Due to the divergence of the second sidewall portions 73, 74 in conjunction with the transition walls 75, 76 between the transition zone T and the second zone 45/volute throat 46, the efficiency of the overall volute housing 10 is increased while the noise/sound is decreased even though uniform compression is maintained only over approximately 0°–180° from the first zone 44 to the transition zone T. However, releasing the compression and providing expansion from the transition zone T toward discharge particularly in an axial direction, has achieved efficiency beyond that heretofore obtained at noticeably decreased noise levels.

The volute housing 10 is also provided with an abutment flange 100 (FIGS. 1 and 3) which extends about the exterior of the discharge nozzle 80 downstream from the discharge opening 81. The flange 100 abuts against the bottom of a convection tray C (FIG. 3) in the manner fully described in applicant's pending application Ser. No. 07/459,221 filed Dec. 29, 1989 and entitled "A Fan Coil Unit." The specifics of the latter, including details of oppositely directed connected tongues or flanges 101, 102 are herein incorporated by reference. However, in addition to the flanges or tongues 101, 102, openings 103, 104 are formed in the discharge nozzle 80 immediately adjacent and below each of the flanges or tongues 101, 102 through which fasteners F (FIG. 3) can be connected to suspendingly secure the volute housing 10 to the convector tray C.

Reference is now made to FIG. 4 which illustrates a modification of the invention in which transition walls 75', 76' are not parallel to the volute peripheral wall 60 but instead are modified to gradually flare from the respective openings 51, 52 toward the respective volute peripheral wall portions 61, 62 of the volute peripheral wall 60. The transition walls 75', 76' now gradually blend with the transition radii 77, 78 between the transition walls 75', 76' and the less abrupt radii 79, 89, respectively, resulting in less cavitation, less noise and still greater efficiency than the more abrupt (90°) transition earlier described between the walls 73, 75 and 74, 76.

Figure 9:
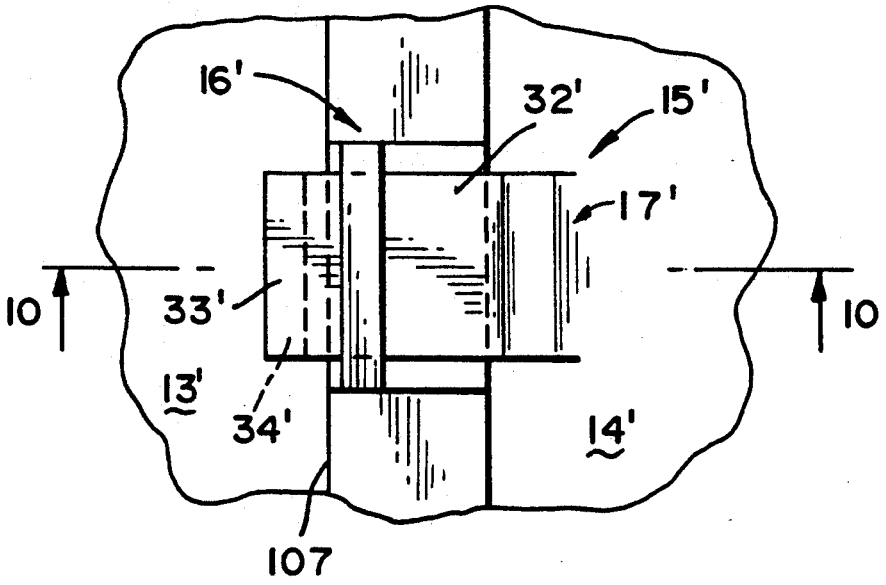
FIG. 9 is a fragmentary elevational view of another pair of male and female snap fasteners, and illustrates the fasteners in secured relationship to each other.
Figure 10:
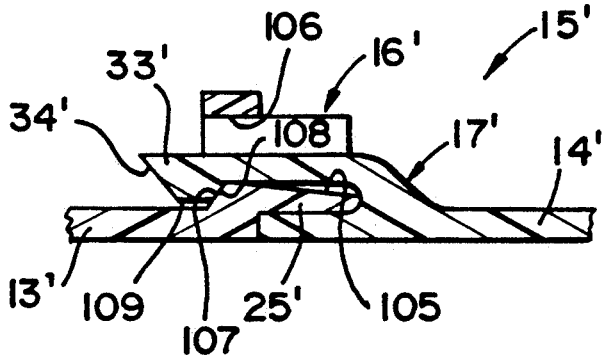
FIG. 10 is a fragmentary cross sectional view taken generally along line 10—10 of FIG. 9, and illustrates details of the secured fasteners.
Figure 11:
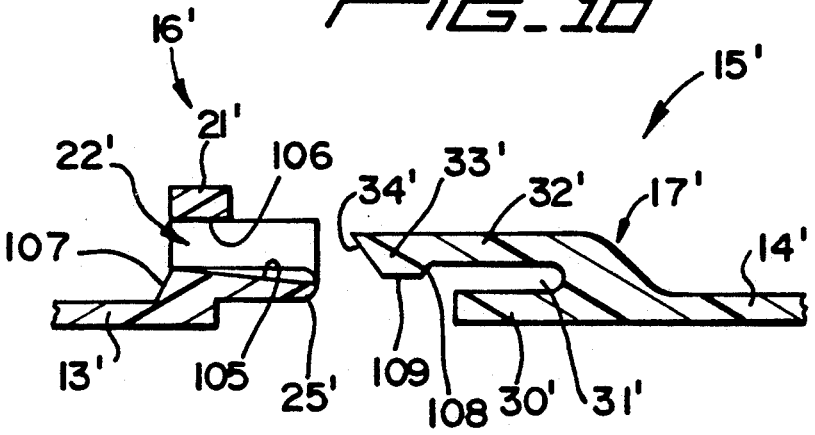
FIG. 11 is a fragmentary cross sectional view similar to FIG. 10 and illustrates the snap fasteners in unfastened relationship to each other.

Reference is now made to FIGS. 9 through 11 of the drawings which illustrates another pair of fasteners 15' which have been primed to designate structure substantially identical to that of the pairs of fasteners 15. In this case a female fastener 16' includes an offset projection or nose 25' but an upper surface 105 thereof is inclined downwardly and to the right, as viewed in FIGS. 10 and 11. An undersurface 106 of a bridge 21' is not provided with a converging entrance surface, as in the case of the undersurface 23 of the bridge 21. Furthermore, a ledge 107 is slightly inclined upwardly and to the right as viewed in FIGS. 10 and 11, as opposed to the generally normal disposition of the ledge 24 relative to the edge 13 of the female fastener 16 (FIG. 6). The male tongue or projection 32' includes a locking lip 33' and a forward inclined surface 34'. However, a rearward surface 108 is inclined and a bottommost surface 109 is generally flat. Thus the locking lip 33' is not pointed, as in the case of the locking lip 33 of FIG. 6.

In order to fasten the fasteners 16', 17', the tongue 32' is moved to the left, as viewed in FIG. 11, and the surface 109 is progressively guided by the surface 105 to feed the locking lip 33' through the female opening 22' which also progressively deflects the tongue 32' upwardly toward and against the underside 106 of the bridge 21'. The bridge 21' prevents the tongue 32' from being over deflected during this fastening operation, and once the locking lip 33' moves beyond the female opening 22', the surfaces 107, 108 lockingly engage each other (FIG. 9) with sufficient force to maintain the fastening means 15' assembled. However, since the surfaces 107, 108 are inclined, release thereof is easier than that heretofore described in conjunction with the surface 35 and ledge 24 of the pair of fasteners 15 which are generally normal to the direction of disassembly. The latter is readily apparent by merely comparing FIG. 10 with the right-hand-most illustration of FIG. 6. However, even with the tapered surfaces 107, 108, the grip is sufficiently adequate to assure that the volute housing 10 is maintained in its assembled condition.

Figure 12:
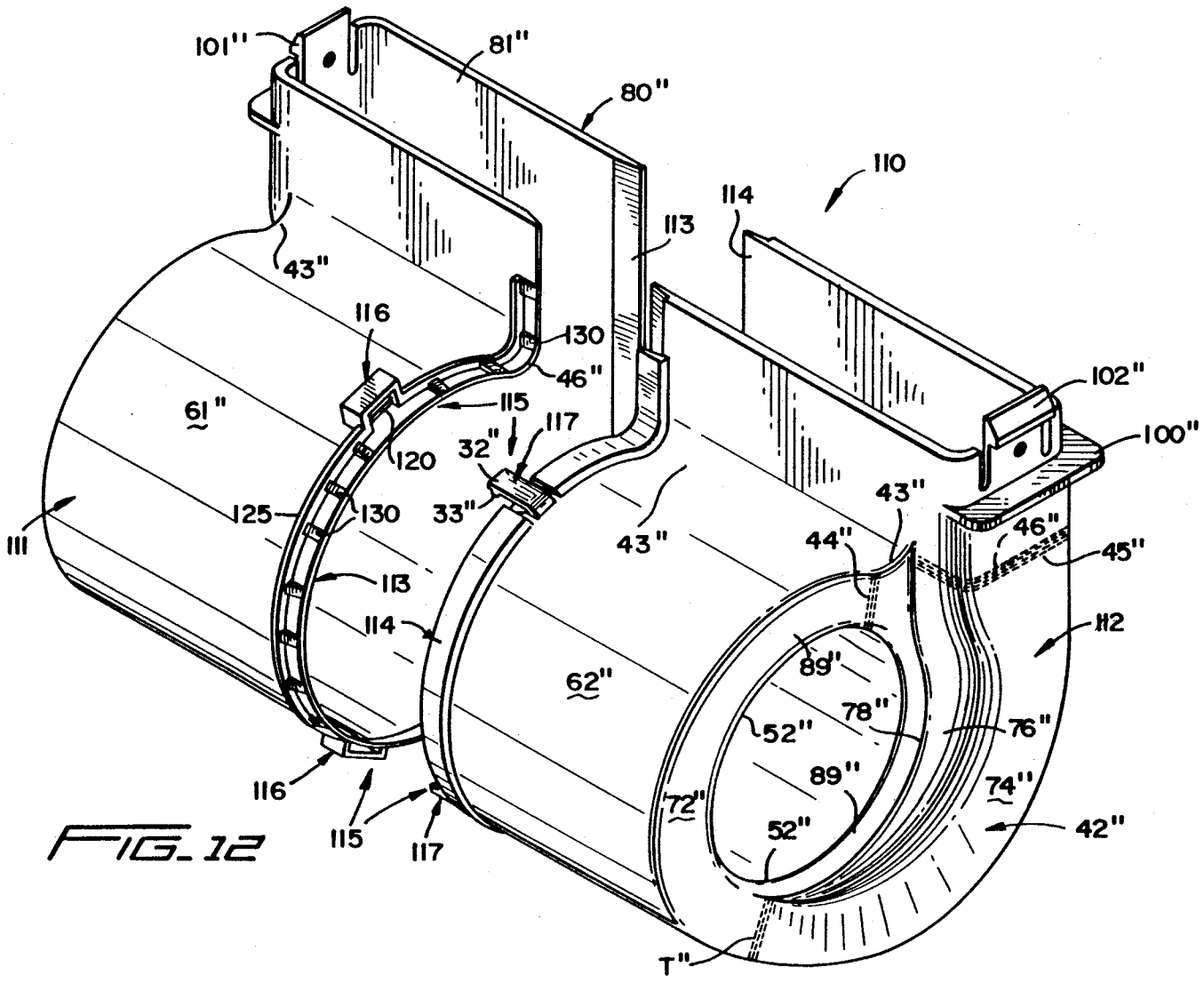
FIG. 12 is a perspective view of another novel volute housing constructed in accordance with this invention, and illustrates a pair of volute housing bodies or parts having peripheral edges adapted to be snap-fastened to each other.

Another volute housing constructed in accordance with this invention is illustrated in FIG. 12 and is generally designated by the reference numeral 110.

Structure of the volute housing 110 which is identical to that of the volute housing 10 has been double primed.

The volute housing 110 includes a housing body defined by a pair of housing parts or halves 111, 112. The housing parts 111, 112 are joined to each other along a generally radial plane (unnumbered) corresponding to the radial plane R of FIGS. 3–5. The housing parts 11, 12 are joined to each other along the radial plane through interlocked edges 113, 114 through pairs of fasteners 115 defined by female fasteners 116 carried by the edge 113 and male fasteners 115 carried by the edge 114.

Figure 13:
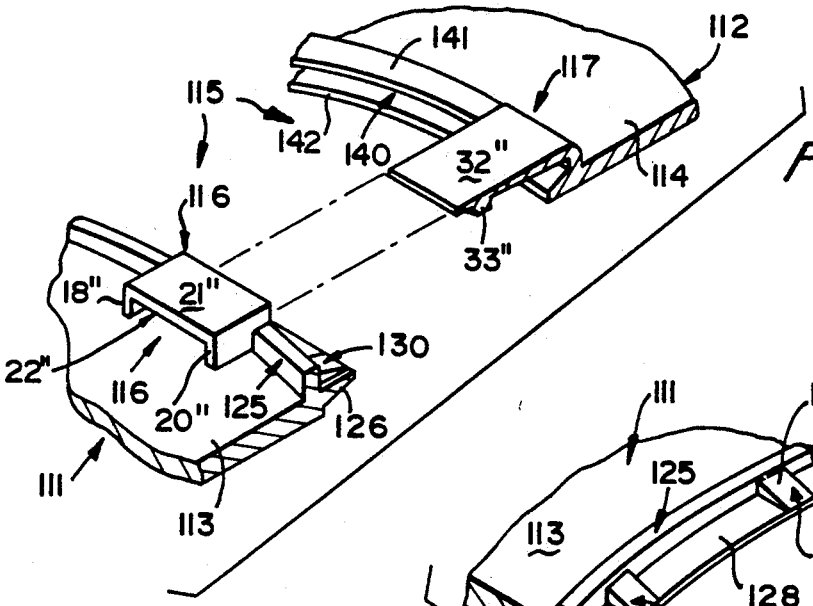
FIG. 13 is a fragmentary enlarged view of a portion of the peripheral edges of the volute housing parts or halves, and illustrates axial alignment of male and female fasteners prior to securing the same to each other, and a nose of one peripheral edge aligned with a channel of the other peripheral edge.

The female fasteners 116 each include a pair of radially projecting spaced legs 18'', 20'' (FIG. 13) spanned by a bridge 21'' and collectively defining a female opening 22''. Within each female opening 22'' and spaced beneath the bridge 21'' thereof is located a generally radially outwardly directed circumferentially extending locking rib 120 having a first inclined surface or face 121, a second inclined surface or face 122, and a top surface or face 123 therebetween. Each of the male fasteners 117 is substantially identical to the male fastener 17' of FIGS. 9 through 11, and includes a tongue or projection 32'', a radially inwardly directed locking lip 33'' and a surface 108'' which locks against the surface 122 of the locking rib 120 when the pairs of fasteners 115 are fastened together in the manner clearly evident in FIG. 15. The assembly and disassembly of the pairs of fasteners 115 need not be described further since the same corresponds to that heretofore described relative to the pairs of fasteners 15' of FIGS. 9 through 11.

Figure 14:
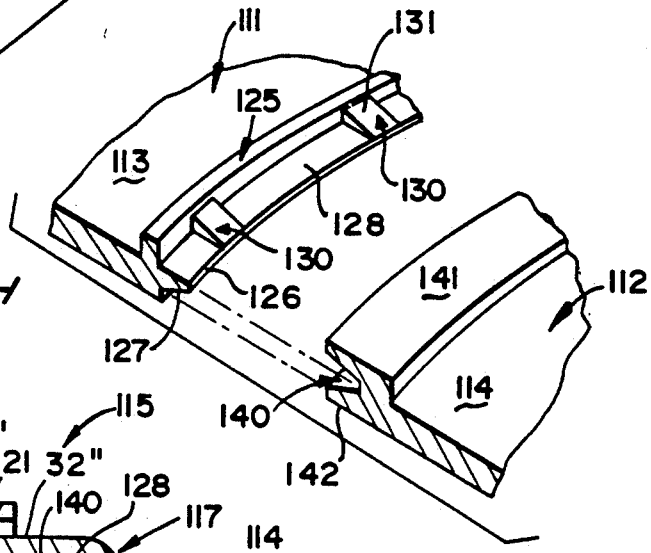
FIG. 14 is a fragmentary perspective view similar to FIG. 13, and illustrates a plurality of circumferentially spaced reinforcing bosses carried by one of the peripheral edges.
Figure 15:
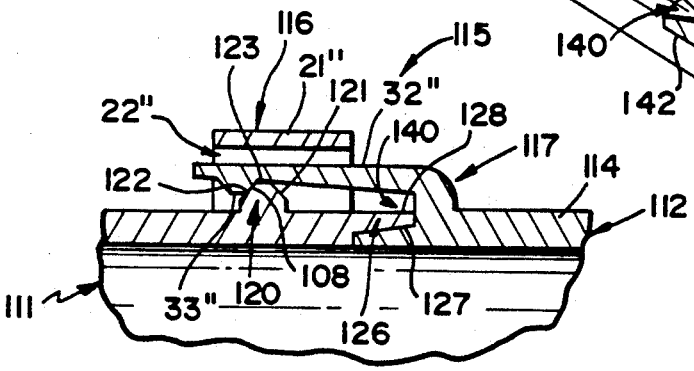
FIG. 15 is a fragmentary cross sectional view illustrating the assembled condition of the volute housing body and illustrates the fasteners interconnected to each other with a nose received in a slot or groove.
Figure 16:
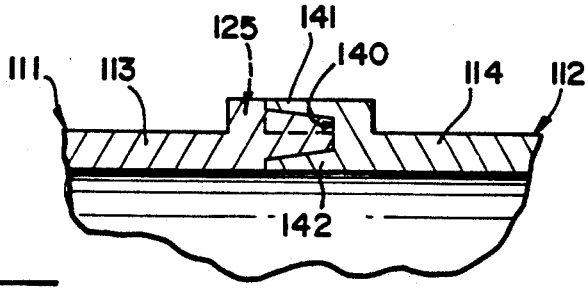
FIG. 16 is a fragmentary cross sectional view similar to FIG. 5, and illustrates the mating configuration between the groove and one of the bosses.

The edge 113 also includes a circumferentially extending radially outwardly directed reinforcing rib 125 forward from which projects a nose 126 having a tapered bottom surface 127 and a relatively flat upper surface 128 (FIG. 14 and 15). A plurality of reinforcing bosses 130 are spaced peripherally from each other, and each includes an upper tapered surface 131. The surfaces 127, 131 merge at a circumferential flat front surface or face 132. The surfaces 127, 131 and 132 are of a transverse cross sectional configuration (FIG. 16) which corresponds to an axially outwardly opening groove or channel 140 defined between a pair of flanges 141, 142 (FIGS. 13 and 16) of the edge 114. The surfaces (unnumbered) of the channel or groove 140 mates with the surfaces 127, 131 and 132, and lends rigidity to the volute housing 110 when the volute parts 111, 112 are held together by the fasteners 115. Since the volute housing parts 111, 112 are formed from injection molded plastic, the tendency thereof is to deflect or warp, particularly along the edges 113, 114 unless otherwise provided for. The spaced bosses 130 and the rib 125 provide both axial and circumferential rigidity to the edge 113 which prevents the same from warping and thus maintains its rigidity over the lifetime thereof. Obviously since the edge 113 is extremely rigid and relatively nondeflectable, once the interlock of FIGS. 15 and 16 is effected between the nose 126 and the groove 140, the rigidity inherent in the edge 113 also rigidifies the interlock and thus the overall connection about the entire periphery of the housing parts 11, 112 along the entire interlock edges 113, 114.

Though the volute housings 10 (FIG. 1) and 110 (FIG. 12) have been described as being formed of two volute parts or bodies 11, 12 and 111, 112, respectively, the same can be made of more numbers of parts, though the same are preferably divided along planes parallel to the radial plane R (FIGS. 3 and 4). For example, two planes R1, R2 (FIGS. 3 and 4) are illustrated, one to either side of the radial plane R. In accordance with this invention the entire portion of the volute housing 10 located between the radial planes R1, R2 could be a single piece of injection molded plastic material, as would be the housing portions to the left and right of the radial planes R1, R2, respectively. These three parts then could be glued together or adjoining parts could be provided with pairs of fasteners, such as the fasteners 15. As an alternative construction, the parts of the volute housing 10 to the left and right, respectively, of the radial planes R1, R2 can be made of injection molded plastic material, whereas the part of the volute housing 10 between the radial planes R1, R2 can be made of galvanized metal. The peripheral edges of the housing parts to the left and right of the radial planes R1, R2, respectively, could be provided with grooves into which would be received the peripheral edges of the galvanized central part, and these could all be appropriately glued to each other. In this fashion one need but mold opposite axial ends of the volute housing 10 and a central portion could be varied in axial length to accommodate different impellers of different axial length.

Figure 17:
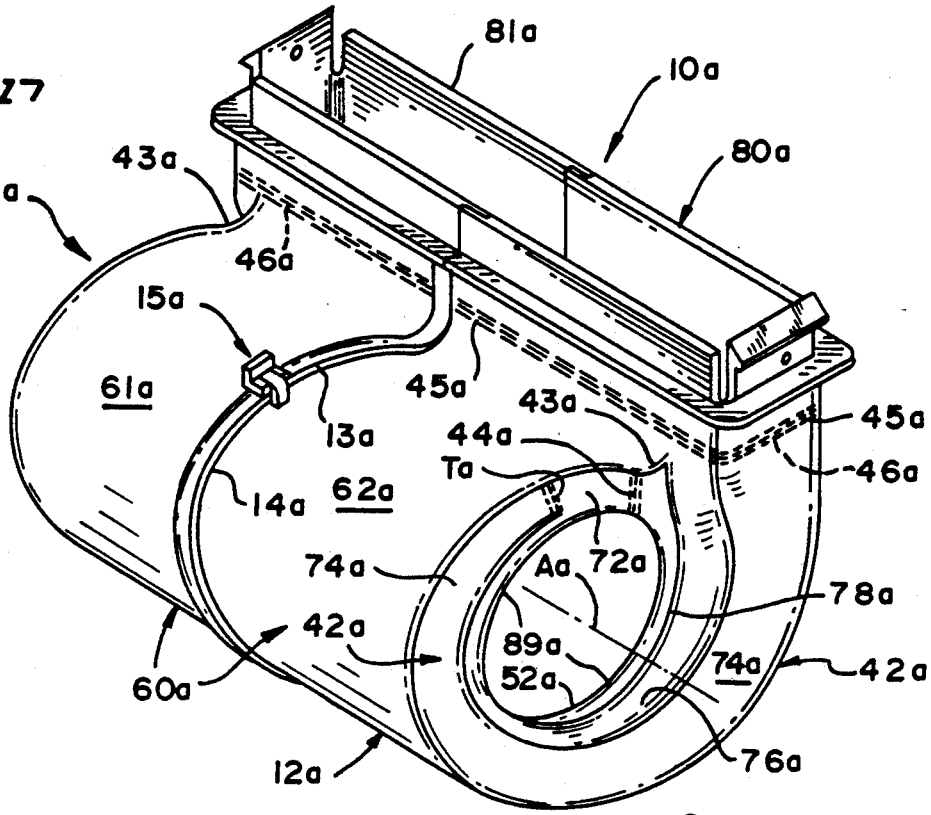
FIG. 17 is a perspective view of another novel volute housing constructed in accordance with this invention which is similar to the volute housing of FIG. 1, and illustrates a sidewall portion which diverges progressively axially outwardly and in the direction of fluid flow between a transition zone (generally 25°) and a volute throat (generally 360°).
Figure 18:
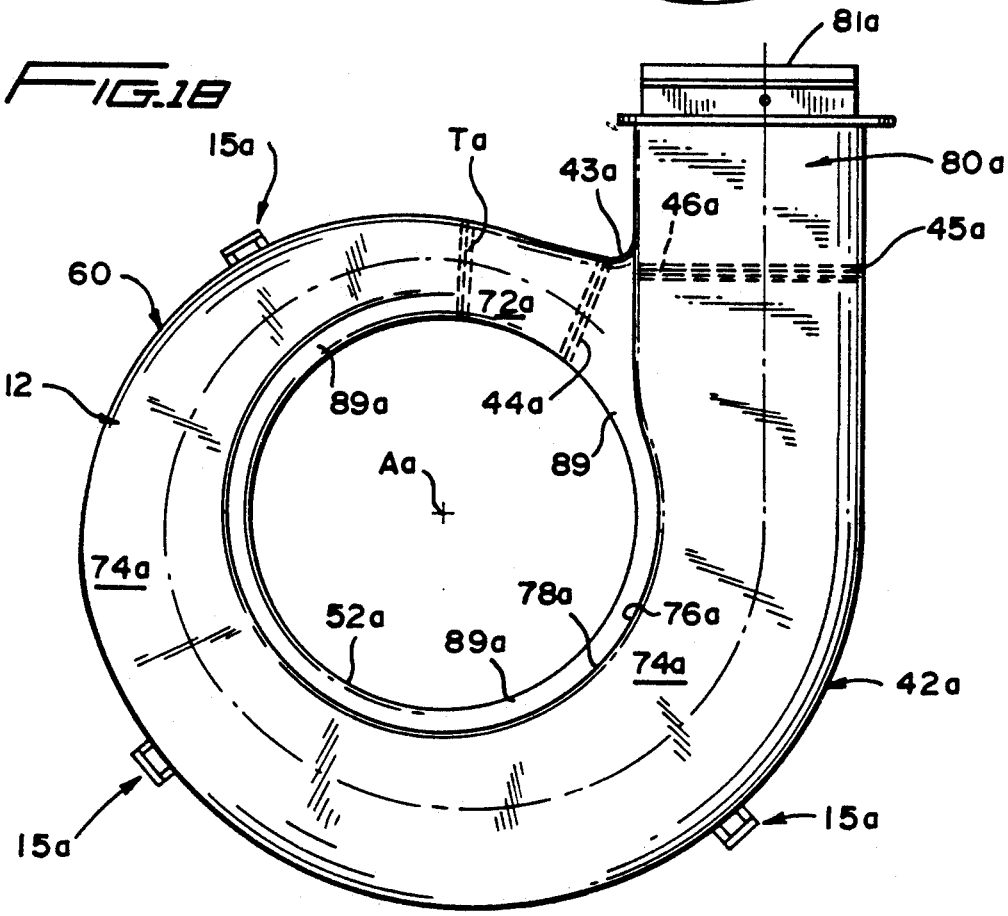
FIG. 18 is an enlarged side elevational view of the volute housing of FIG. 1, and illustrates structural details of the volute housing.

Reference is made to another volute housing constructed in accordance with this invention which is illustrated in FIGS. 17 and 18 of the drawings, and since the same is similar to the volute housing 10 of FIGS. 1 through 5, identical reference numerals have been applied thereto followed by the suffix "a".

As in the case of the volute housing 10, a volute housing **10*a* of FIGS. 17 ad 18 is designed for use with a centrifugal fan, blower or the like, and includes a housing body defined by a pair of housing parts or halves 11*a*, 12*a*. The housing parts 11*a*, 12*a* are joined to each other along a generally radial plane through interlocked edges 13*a*, 14*a* (FIG. 17**).

The edges **13*a*, 14*a*, carry pairs of fasteners 15*a* identical to fasteners 15 of the volute housing 10**.

A generally circular fluid inlet opening **52*a* is defined by each of opposite sidewalls 42*a*. The circular fluid inlet openings 52*a*** have a coincident axis Aa.

The volute housing **10*a* includes a volute peripheral wall 60*a* defined by a volute peripheral wall portion 61*a* of the volute housing half or part 11*a* and a volute peripheral wall portion 62*a* of the volute housing part 12*a*. The volute peripheral wall 60*a* extends generally from a volute tongue or cut-off 43*a* which is located generally at a first zone 44*a* of minimum radial dimension or distance relative to the openings 52*a* to a second zone 45*a* located at a volute throat 46*a*. The direction of fluid flow is counterclockwise relative to the volute peripheral wall 60*a*, as viewed in FIG. 18, and each of the sidewalls 42*a* progressively increase in radial size in the direction of fluid travel from the first zone 44*a* of minimum radial dimension to the second zone 45*a* of maximum radial dimension. The arcuate distance between the first zone 44*a* and the volute tongue or cut-off point 43*a* and the second zone 45*a* or volute throat 46*a* in the direction of fluid flow is generally 360° (FIG. 18**).

Each of the sidewalls **42*a* includes respective first sidewall portions 72*a* and second sidewall portions 74*a*. The first sidewall portions 72*a* are in generally parallel relationship to each other and extend approximately 25° from the first zone 44*a* and tongue 43*a* to a transition zone Ta, as measured counterclockwise in FIG. 18. Thus, fluid/air flow between generally the tongue or cut-off 43*a* and the first zone 44*a* up to the transition zone Ta will be confined radially against expansion by the generally parallel sidewall portions 72*a*, 72*a*. After the transition zone Ta and up to the second zone 45*a*/volute throat 46*a*, the second wall portions 74*a*, 74*a* progressively diverge away from each other in the direction of fluid flow, much as in the manner illustrated in FIG. 5 relative to the volute housing 10. Thus, the fluid/air travelling from the transition zone Ta to the volute throat 46*a*/second zone 45*a* will expand radially outwardly eventually exiting through a generally polygonal discharge nozzle 80*a* having a discharge opening 81*a*. The cross sectional configuration at the volute throat 46*a* corresponds to the cross sectional configuration of the discharge opening 81*a* of the discharge nozzle 80*a*, and thus between the volute throat 46*a* and the discharge opening 81*a***, no further expansion of the fluid/air takes place.

Axial transition walls **76*a* bridge between the respective openings 52*a* and the second sidewall portions 74*a* of each of the sidewalls 42*a*. The axial transition walls 76*a* merge very abruptly with the respective second sidewall portions 74*a* at sharp radii or radius portions 78*a*. The radii 78*a* are relatively abrupt (just as in the case of the radii 78 in FIG. 4) and merge with less abrupt radii or radius portions 89*a*. The axial transition wall 76*a* and the radii 78*a* begin at the transition zone Ta and progressively widen radially (See FIG. 17) to the volute throat 46*a*/second zone 45*a*. While the abrupt radii 78*a* extend generally only between the transition zone Ta to the volute throat 46*a*/second zone 45*a*, the less abrupt radii 89*a* extend a full 360° about the fluid inlet openings 52 imparting a generally axially inwardly converging funnel-like configuration thereto. Because of the latter construction a continuous uniform circumferential inlet gap is formed between an impeller (not shown) associated with the volute housing 10*a* and the gradual radii 89*a* thereof. This causes uniform circumferential air flow into the volute housing 10*a* which balances not only the air flow, but in turn balances the torque on the impeller, its shaft and the associated drive motor (not shown) resulting in minimal vibration. The transition walls 76*a* are generally in parallel relationship to the portions of the volute peripheral wall portions 61*a*, 62*a* radially opposite thereto. Accordingly, as fluid/air flows between the transition zone T and the volute throat 46*a*/second zone 45*a*, the fluid/air can expand radially outwardly because of the divergent nature of the second wall portions 74a but is constrained against radial expansion until reaching the volute throat 46a/second zone 45a**.

From the foregoing, the radial cross section through the first zone 44a defines the minimum cross sectional volume of the volute fluid chamber (unnumbered) with, of course, the fluid chamber being established generally as that volume between the volute peripheral wall 60a and the inlet openings 52a or the outer periphery of an impeller (not shown) mounted in the volute housing 10a. This cross sectional volume progressively increases in the direction of fluid/air flow as, for example, in the direction of selected radial planes X—X, Y—Y, Z—Z, etc. associated with the volute housing 10 until reaching a maximum at the transition zone Ta. However, during the enlargement of the volumes between generally 0° and 25°, all of the enlargement of chamber volume is through radial expansion and not through axial expansion because of the generally parallel relationship of the first sidewall portions 72a of the opposite sidewalls 42a. However, the cross sectional volume of the air/fluid chamber beginning at the transition zone Ta progressively increases toward the second zone 45a/volute throat 46a, not only radially but also axially, because of the progressive divergence of the second sidewall portions 74a toward and to the volute throat 46a/second zone 45a. At the latter zone the cross sectional volume remains generally unchanged as it passes through the discharge nozzle 80a exiting the discharge opening 81a thereof. Due to the divergence of the second sidewall portions 74a in conjunction with the transition walls 76a between the transition zone Ta and the second zone 45a/volute throat 46a, the efficiency of the overall volute housing 10a is increased while the noise/sound is decreased even though uniform compression is maintained only over approximately 0°-25° from the first zone 44a to the transition zone Ta. However, releasing the compression and providing expansion from the transition zone Ta toward discharge particularly in an axial direction, has achieved efficiency beyond that heretofore obtained at noticeably decreased noise levels.

Figure 19:
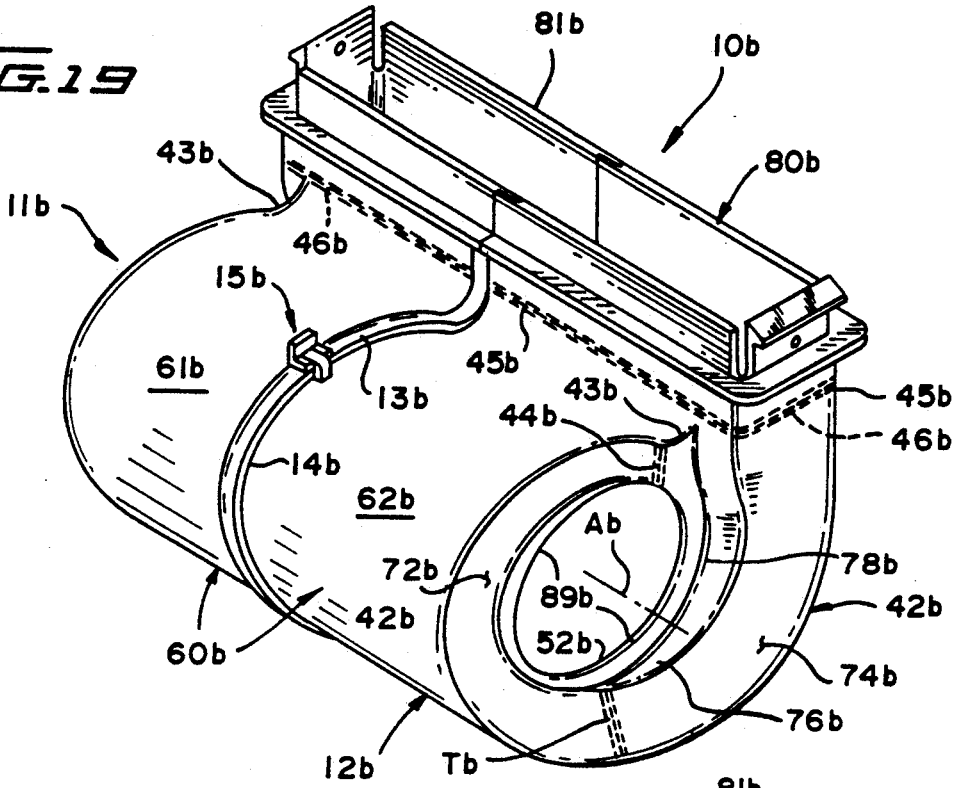
FIG. 19 is a perspective view of another novel volute housing constructed in accordance with this invention which is similar to the volute housing of FIG. 1, and illustrates a sidewall portion which diverges progressively axially outwardly and in the direction of fluid flow between a transition zone (generally 220°) and a volute throat (generally 360°).
Figure 20:
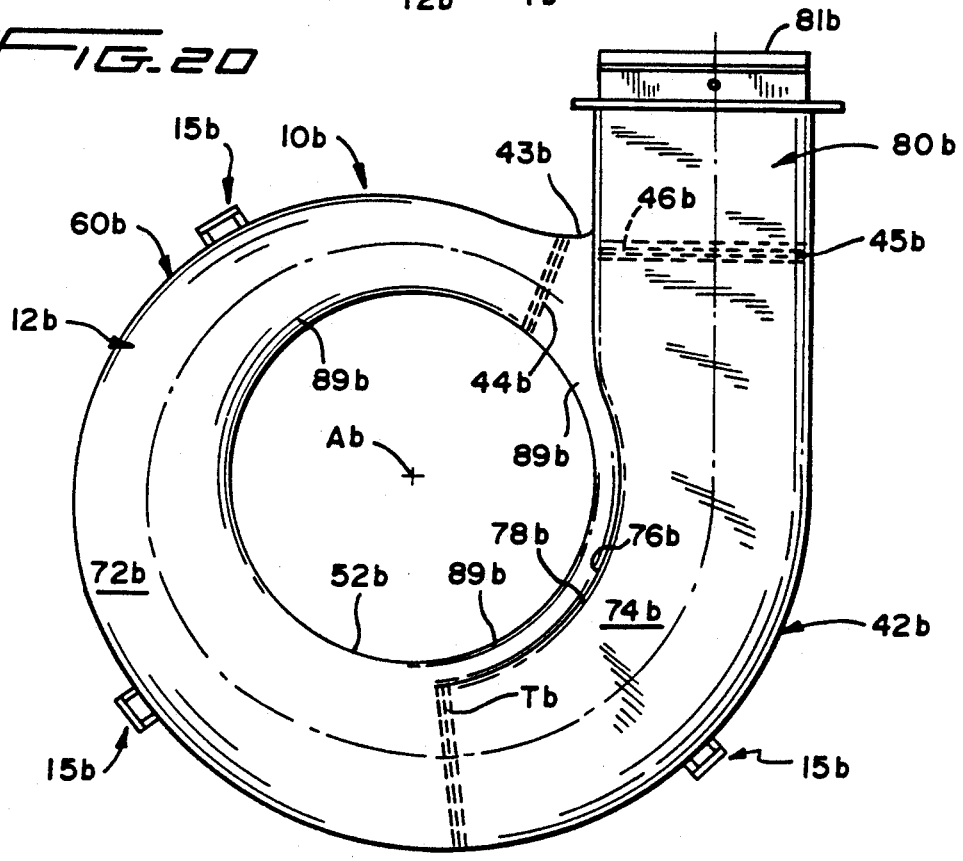
FIG. 20 is an enlarged side elevational view of the volute housing of FIG. 19, and illustrates structural details of the volute housing.

Reference is made to another volute housing constructed in accordance with this invention which is illustrated in FIGS. 19 and 20 of the drawings, and since the same is similar to the volute housing 10 of FIGS. 1 through 5, identical reference numerals have been applied thereto followed by the suffix "b".

As in the case of the volute housing 10, a volute housing 10b of FIGS. 19 and 20 is designed for use with a centrifugal fan, blower or the like, and includes a housing body defined by a pair of housing parts or halves 11b, 12b. The housing parts 11b, 12b are joined to each other along a generally radial plane through interlocked edges 13b, 14b (FIG. 19).

The edges 13b, 14b, carry pairs of fasteners 15b identical to fasteners 15 of the volute housing 10.

A generally circular fluid inlet opening 52b is defined by each of opposite sidewalls 42b. The circular fluid inlet openings 52b have a coincident axis A*b*.

The volute housing 10b includes a volute peripheral wall 60b defined by a volute peripheral wall portion 61b of the volute housing half or part 11b and a volute peripheral wall portion 62b of the volute housing part 12b. The volute peripheral wall 60b extends generally from a volute tongue or cut-off 43b which is located generally at a first zone 44b of minimum radial dimension or distance relative to the openings 52b to a second zone 45b located at a volute throat 46b. The direction of fluid flow is counterclockwise relative to the volute peripheral wall 60b, as viewed in FIG. 20, and each of the sidewalls 42b progressively increase in radial size in the direction of fluid travel from the first zone 44b of minimum radial dimension to the second zone 45b of maximum radial dimension. The arcuate distance between the first zone 44b and the volute tongue or cut-off point 43b and the second zone 45b or volute throat 46b in the direction of fluid flow is generally 360° (FIG. 20).

Each of the sidewalls 42b includes respective first sidewall portions 72b and second sidewall portions 74b. The first sidewall portions 72b are in generally parallel relationship to each other and extend approximately 220° from the first zone 44b and tongue 43b to a transition zone Tb, as measured counterclockwise in FIG. 20. Thus, fluid/air flow between generally the tongue or cut-off 43b and the first zone 44b up to the transition zone Tb will be confined radially against expansion by the generally parallel sidewall portions 72b, 72b. After the transition zone Tb and up to the second zone 45b/volute throat 46b, the second wall portions 74b, 74b progressively diverge away from each other in the direction of fluid flow, much as in the manner illustrated in FIG. 5 relative to the volute housing 10. Thus, the fluid/air travelling from the transition zone Tb to the volute throat 46a/second zone 45b will expand radially outwardly eventually exiting through a generally polygonal discharge nozzle 80a having a discharge opening 81b. The cross sectional configuration at the volute throat 46b corresponds to the cross-sectional configuration of the discharge opening 81b of the discharge nozzle 80b, and thus between the volute throat 46b and the discharge opening 81b, no further expansion of the fluid/air takes place.

Axial transition walls 76b bridge between the respective openings 52b and the second sidewall portions 74b of each of the sidewalls 42b. The axial transition walls 76b merge very abruptly with the respective second sidewall portions 74b at sharp radii or radius portions 78b. The radii 78b are relatively abrupt (just as in the case of the radii 78 in FIG. 4) and merge with less abrupt radii or radius portions 89b. The axial transition wall 76b and the radii 78b begin at the transition zone Tb and progressively widen radially (See FIG. 19) to the volute throat 46b/second zone 45b. While the abrupt radii 78b extend generally only between the the transition zone Tb to the volute throat 46b/second zone 45b, the less abrupt radii 89b extend a full 360° about the fluid inlet openings 52 imparting a generally axially inwardly converging funnel-like configuration thereto. Because of the latter construction a continuous uniform circumferential inlet gap is formed between an impeller (not shown) associated with the volute housing 10b and the gradual radii 89b thereof. This causes uniform circumferential air flow into the volute housing 10b which balances not only the air flow, but in turn balances the torque on the resulting in minimal vibration. The transition walls 76b are generally in parallel relationship to the portions of the volute peripheral wall portions 61b, 62b radially opposite thereto. Accordingly, as fluid/air flows between the transition zone T and the volute throat 46b/second zone 45b, the fluid/air can expand radially outwardly because of the divergent nature of the second wall portions 74b but is constrained against radial expansion until reaching the volute throat 46b/second zone 45b.

From the foregoing, the radial cross section through the first zone 44b defines the minimum cross sectional volume of the volute fluid chamber (unnumbered) with, of course, the fluid chamber being established generally as that volume between the volute peripheral wall 60b and the inlet openings 52b or the outer periphery of an impeller (not shown) mounted in the volute housing 10b. This cross sectional volume progressively increases in the direction of fluid/air flow as, for example, in the direction of selected radial planes X—X, Y—Y, Z—Z, etc. associated with the volute housing 10 until reaching a maximum at the transition zone Tb. However, during the enlargement of the volumes between generally 0° and 220°, all of the enlargement of chamber volume is through radial expansion and not through axial expansion because of the generally parallel relationship of the first sidewall portions 72b of the opposite sidewalls 42b. However, the cross sectional volume of the air/fluid chamber beginning at the transition zone Tb progressively increases toward the second zone 45b/volute throat 46b, not only radially but also axially, because of the progressive divergence of the second sidewall portions 74b toward and to the volute throat 46b/second zone 45b. At the latter zone the cross sectional volume remains generally unchanged as it passes through the discharge nozzle 80b exiting the discharge opening 81b thereof. Due to the divergence of the second sidewall portions 74b in conjunction with the transition walls 76b between the transition zone Tb and the second zone 45b/volute throat 46b, the efficiency of the overall volute housing 10b is increased while the noise/sound is decreased even though uniform compression is maintained only over approximately 0°–220° from the first zone 44b to the transition zone Tb. However, releasing the compression and providing expansion from the transition zone Tb toward discharge particularly in an axial direction, has achieved efficiency beyond that heretofore obtained at noticeably decreased noise levels.

Figure 21:
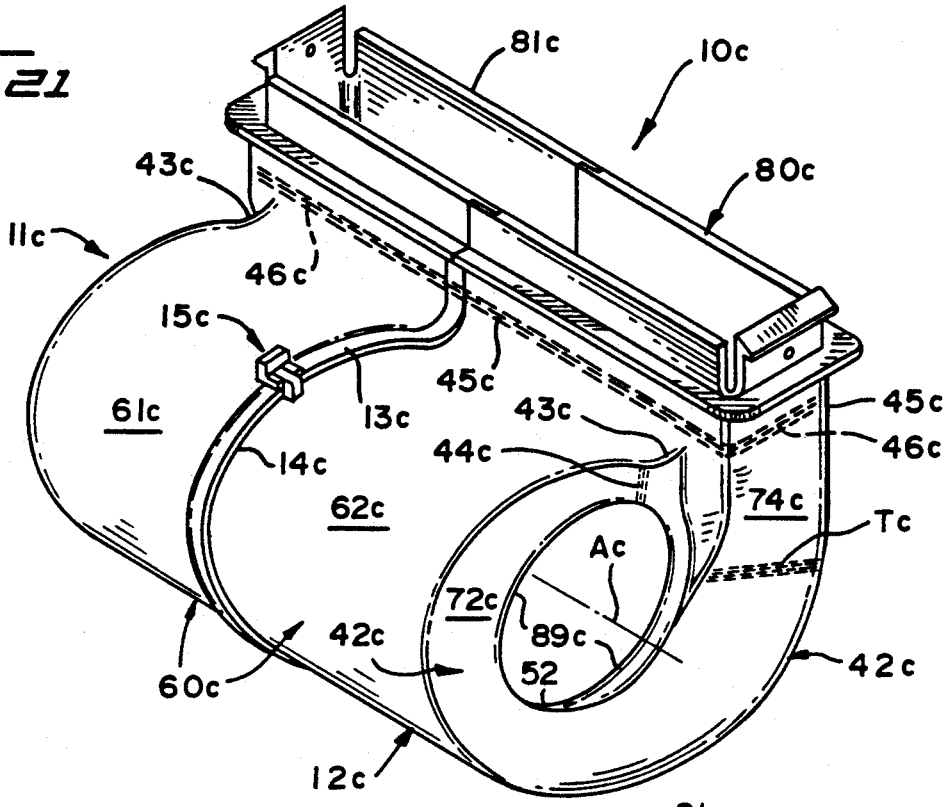
FIG. 21 is a perspective view of a novel volute housing constructed in accordance with this invention which is similar to the volute housing of FIG. 1, and illustrates a sidewall portion which diverges progressively outwardly and in the direction of fluid flow between a transition zone (generally 320°) and a volute throat (generally 360°).
Figure 22:
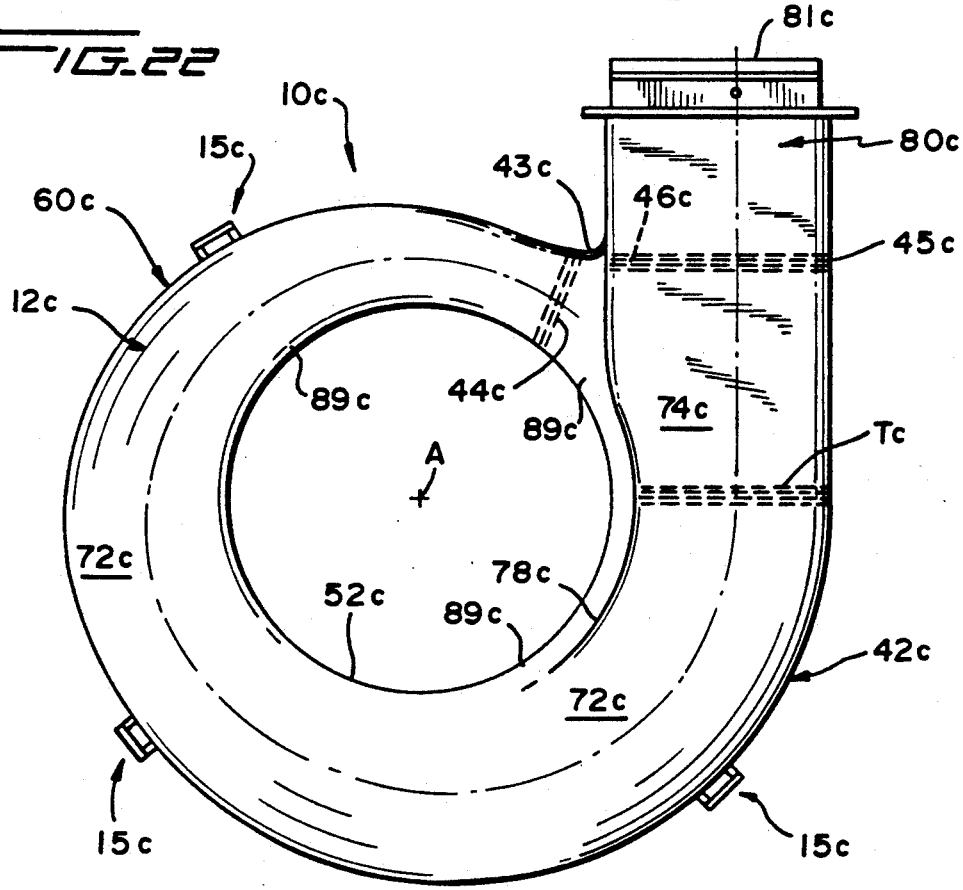
FIG. 22 is an enlarged side elevational view of the volute housing of FIG. 21, and illustrates structural details of the volute housing.

Reference is made to another volute housing constructed in accordance with this invention which is illustrated in FIGS. 21 and 22 of the drawings, and since the same is similar to the volute housing 10 of FIGS. 1 through 5, identical reference numerals have been applied thereto followed by the suffix "c".

As in the case of the volute housing 10, a volute housing 10c of FIGS. 21 and 22 is designed for use with a centrifugal fan, blower or the like, and includes a housing body defined by a pair of housing parts or halves 11c, 12c. The housing parts 11c, 12c are joined to each other along a generally radial plane through interlocked edges 13c, 14c (FIG. 21).

The edges 13c, 14c, carry pairs of fasteners 15c identical to fasteners 15 of the volute housing 10.

A generally circular fluid inlet opening 52c a is defined by each of opposite sidewalls 42c. The circular fluid inlet openings 52c have a coincident axis Ac.

The volute housing 10c includes a volute peripheral wall 60c defined by a volute peripheral wall portion 61c of the volute housing half or part 11c and a volute peripheral wall portion 62c of the volute housing part 12c. The volute peripheral wall 60c extends generally from a volute tongue or cut-off 43c which is located generally at a first zone 44c of minimum radial dimension or distance relative to the openings 52c to a second zone 45c located at a volute throat 46c. The direction of fluid flow is counterclockwise relative to the volute peripheral wall 60c, as viewed in FIG. 22, and each of the sidewalls 42c progressively increase in radial size in the direction of fluid travel from the first zone 44c of minimum radial dimension to the second zone 45c of maximum radial dimension. The arcuate distance between the first zone 44c and the volute tongue or cut-off point 43c and the second zone 45c or volute throat 46c in the direction of fluid flow is generally 360° (FIG. 22).

Each of the sidewalls 42c includes respective first sidewall portions 72c and second sidewall portions 74c. The first sidewall portions 72c are in generally parallel relationship to each other and extend approximately 320° from the first zone 44c and tongue 43c to a transition zone Tc, as measured counterclockwise in FIG. 22. Thus, fluid/air flow between generally the tongue or cut-off 43c and the first zone 44c up to the transition zone Tc will be confined radially against expansion by the generally parallel sidewall portions 72c, 72c. After the transition zone Tc and up to the second zone 45c/volute throat 46c, the second wall portions 74c, 74c progressively diverge away from each other in the direction of fluid flow, much as in the manner illustrated in FIG. 5 relative to the volute housing 10. Thus, the fluid/air travelling from the transition zone Tc to the volute throat 46c/second zone 45c will expand radially outwardly eventually exiting through a generally polygonal discharge nozzle 80c having a discharge opening 81c. The cross sectional configuration at the volute throat 46c corresponds to the cross sectional configuration of the discharge opening 81c of the discharge nozzle 80c, and thus between the volute throat 46c and the discharge opening 81c, no further expansion of the fluid/air takes place.

Axial transition walls 76c bridge between the respective openings 52c and the second sidewall portions 74c of each of the sidewalls 42c. The axial transition walls 76c merge very abruptly with the respective second sidewall portions 74c at sharp radii or radius portions 78c. The radii 78c are relatively abrupt (just as in the case of the radii 78 in FIG. 4) and merge with less abrupt radii or radius portions 89c. The axial transition wall 76c and the radii 78c begin at the transition zone Tc and progressively widen radially (See FIG. 21) to the volute throat 46c/second zone 45c. while the abrupt radii 78c extend generally only between the transition zone Tc to the volute throat 46c/second zone 45c, the less abrupt radii 89c extend a full 360° about the fluid inlet openings 52 imparting a generally axially inward converging funnel-like configuration thereto. Because of the latter construction a continuous uniform circumferential inlet gap is formed between an impeller (not shown) associated with the volute housing 10c and the gradual radii 89c thereof. This causes uniform circumferential air flow into the volute housing 10c which balances not only the air flow, but in turn balances the torque on the impeller, its shaft and the associated drive motor (not shown) resulting in minimal vibration. The transition walls 76c are generally in parallel relationship to the portions of the volute peripheral wall portions 61c, 62c radially opposite thereto. Accordingly, as fluid/air flows between the transition zone T and the volute throat 46c/second zone 45c, the fluid/air can expand radially outwardly because of the divergent nature of the second wall portions 74c but is constrained against radial expansion until reaching the volute throat 46c/second zone 45c.

From the foregoing, the radial cross section through the first zone 44c defines the minimum cross sectional volume of the volute fluid chamber (unnumbered) with, of course, the fluid chamber being established generally as that volume between the volute peripheral wall 60c and the inlet openings 52c or the outer periphery of an impeller (not shown) mounted in the volute housing 10c. This cross sectional volume progressively increases in the direction of fluid/air flow as, for example, in the direction of selected radial planes X—X, Y—Y, Z—Z, etc. associated with the volute housing 10 until reaching a maximum at the transition zone Tc. However, during the enlargement of the volumes between generally 0° and 320°, all of the enlargement of chamber volume is through radial expansion and not through axial expansion because of the generally parallel relationship of the first sidewall portions 72c of the opposite sidewalls 42c. However, the cross sectional volume of the air/fluid chamber beginning at the transition zone Tc progressively increases toward the second zone 45c/volute throat 46c, not only radially but also axially, because of the progressive divergence of the second sidewall portions 74c toward and to the volute throat 46c/second zone 45c. At the latter zone the cross sectional volume remains generally unchanged as it passes through the discharge nozzle 80c exiting the discharge opening 81c thereof. Due to the divergence of the second sidewall portions 74c in conjunction with the transition walls 76c between the transition zone Tc and the second zone 45c/volute throat 46c, the efficiency of the overall volute housing 10c is increased while the noise/sound is decreased even though uniform compression is maintained only over approximately 0°-320° from the first zone 44c to the transition zone Tc. However, releasing the compression and providing expansion from the transition zone Tc toward discharge particularly in an axial direction, has achieved efficiency beyond that heretofore obtained at noticeably decreased noise levels.

Although a preferred embodiment of the invention has been specifically illustrated and described herein, it is to be understood that minor variations may be made in the apparatus without departing from the spirit and scope of the invention as defined in the appended claims.

I claim:

1. A volute housing for a centrifugal fan, blower or the like comprising a housing body defined by opposite spaced sidewalls, a generally circular fluid inlet opening in each sidewall, said generally circular fluid inlet openings having a coincident axis, a volute peripheral wall disposed between said sidewalls and defining therewith a volute chamber, said sidewalls each having a generally minimum radial dimension located at a first zone adjacent a tongue of said volute chamber, said sidewalls each having a first sidewall portion extending arcuately from said first zone generally in the range of between 25 degrees to 320 degrees to a transition zone, said first sidewall portions being in generally parallel relationship to each other between said first zone said transition zone, said sidewalls each having a second sidewall portion extending arcuately from said transition zone generally to said volute throat, and said second sidewall portions being in diverging relationship to each other in a direction away from said transition zone toward said volute throat whereby fluid flowing through said housing body in a direction from said transition zone toward said throat expands progressively axially outwardly as it flows between and along said second sidewall portions.

2. The volute housing as defined in claim 1 wherein said range is preferably between 150 degrees to 200 degrees.

3. The volute housing as defined in claim 1 wherein said range is preferably between 180 degrees and 200 degrees.

4. The volute housing as defined in claim 1 wherein said first and second sidewall portions each merge with a circumferential wall having a terminal edge defining each of said circular fluid inlet openings, and each of said circumferential walls is directed generally axially inwardly imparting a generally axially inwardly directed funnel-like configuration to each of said circumferential walls.

5. The volute housing as defined in claim 4 wherein said range is preferably between 150 degrees to 200 degrees.

6. The volute housing as defined in claim 4 wherein said range is preferably between 180 degrees and 200 degrees.

7. The volute housing as defined in claim 1 wherein each of said fluid openings is defined by an axially inwardly directed rounded radius portion extending substantially 360 degrees which imparts a generally axially inwardly directed funnel-like configuration to each of said rounded radius portions.

8. The volute housing as defined in claim 7 wherein said range is preferably between 150 degrees to 200 degrees.

9. The volute housing as defined in claim 7 wherein said range is preferably between 180 degrees and 200 degrees.

10. The volute housing as defined in claim 1 wherein each of said fluid openings is defined by an axially inwardly directed rounded radius portion extending substantially 360 degrees which imparts a generally axially inwardly directed funnel-like configuration to each of said rounded radius portions, a relatively abrupt radius portion disposed between each of said gradually rounded radius portions and an associated second sidewall portion, said relatively abrupt radius portions each extend circumferentially generally from said transition zone toward said volute throat.

11. The volute housing as defined in claim 10 wherein said range is preferably between 150 degrees to 200 degrees.

12. The volute housing as defined in claim 10 wherein said range is preferably between 180 degrees and 200 degrees.

13. The volute housing as defined in claim 1 wherein each of said fluid openings is defined by an axially inwardly directed rounded radius portion extending substantially 360 degrees which imparts a generally axially inwardly directed funnel-like configuration to each of said rounded radius portions, a relatively abrupt radius portion disposed between each of said gradually rounded radius portions and an associated second sidewall portion, said relatively abrupt radius portions each extend circumferentially generally from said transition zone toward said volute throat, and said second sidewall portion of each sidewall includes generally radially inboard and radially outboard portions and a generally axial transition wall between each radially outboard second sidewall portion and an adjacent relatively abrupt radius portion.

14. A volute housing for a centrifugal fan, blower or the like comprising a housing body defined by opposite spaced sidewalls, a generally circular fluid inlet opening in each sidewall, said generally circular fluid inlet openings having a coincident axis, a volute peripheral wall disposed between said sidewalls and defining therewith a volute chamber, said sidewalls each having a generally minimum radial dimension located at a first zone adjacent a tongue of said volute chamber and progressively increasing to a maximum radial dimension located at a second zone adjacent a throat of said volute chamber, the arcuate distance between said first and second zones being beyond 270 degrees, said sidewalls each having a first sidewall portion extending arcuately from said first zone generally to said second zone, said first sidewall portions being in diverging relationship to each other in a direction away from said first zone toward said second zone whereby fluid flowing through said housing body in a direction from said first zone toward said throat expands progressively axially outwardly as it flows between and along said second sidewall portions, and each of said fluid openings is defined by an axially inwardly directed rounded radius portion extending substantially 360 degrees which imparts a generally axially inwardly directed funnel-like configuration to each of said rounded radius portions.

15. The volute housing as defined in claim 14 wherein said arcuate distance between said first and second zones extends generally from said tongue to said throat.

16. The volute housing as defined in claim 14 wherein said arcuate distance between said first and second zones extends generally 360 degrees from said tongue to said throat.

17. A volute housing for a centrifugal fan, blower or the like comprising a housing body defined by opposite spaced sidewalls, a generally circular fluid inlet opening in each sidewall, said generally circular fluid inlet openings having a coincident axis, a volute peripheral wall disposed between said sidewalls and defining therewith a volute chamber, said sidewalls each having a generally minimum radial dimension located at a first zone adjacent a tongue of said volute chamber, said sidewalls each having a first sidewall portion extending arcuately from said first zone generally in the range of between 25 degrees to 320 degrees to a transition zone, said first sidewall portions being in generally parallel relationship to each other between said first zone and said transition zone, said sidewalls each having a second sidewall portion extending arcuately from said transition zone generally to said volute throat, and said second sidewall portions being in diverging relationship to each other in a direction away from said transition zone toward said volute throat, each second sidewall portion being defined by a substantially axially outermost wall portion disposed between said volute peripheral wall and an inner substantially radially disposed circumferential extending wall portion being in substantial constantly progressive diverging relationship in a direction away from said transition zone toward said throat expands substantially constantly progressively axially outwardly as it flows between and along said second sidewall portions.

18. The volute housing as defined in claim 17 wherein said range is preferably between 150 degrees to 200 degrees.

19. The volute housing as defined in claim 17 wherein said range is preferably between 180 degrees and 200 degrees.

20. The volute housing as defined in claim 17 wherein said first sidewall portion and said inner substantially radially disposed circumferential extending wall portions each merge with an innermost circumferential wall having a terminal edge defining each of said circular fluid inlet openings, and each of said innermost circumferential walls is directed generally axially inwardly imparting a generally axially inwardly directed funnel-like configuration to each of said circumferential walls.

21. The volute housing as defined in claim 20 wherein said range is preferably between 150 degrees to 200 degrees.

22. The volute housing as defined in claim 20 wherein said range is preferably between 180 degrees and 200 degrees.

23. The volute housing as defined in claim 17 wherein each said fluid openings is defined by an axially inwardly directed rounded radius portion extending substantially 360 degrees which imparts a generally axially inwardly directed funnel-like configuration to each of said rounded radius portions.

24. The volute housing as defined in claim 23 wherein said range is preferably between 150 degrees to 200 degrees.

25. The volute housing as defined in claim 23 wherein said range is preferably between 180 degrees and 200 degrees.

26. The volute housing as defined in claim 17 wherein each of said fluid openings is defined by an axially inwardly directed rounded radius portion extending substantially 360 degrees which imparts a generally axially inwardly directed funnel-like configuration to each of said rounded radius portions, a relatively abrupt radius portion disposed between each of said gradually rounded radius portions and an associated inner substantially radially disposed circumferential extending wall portion, and said relatively abrupt radius portions each extend circumferential generally from said transition zone towards said volute throat.

27. The volute housing as defined in claim 26 wherein said range is preferably between 150 degrees to 200 degrees.

28. The volute housing as defined in claim 26 wherein said range is preferably between 180 degrees and 200 degrees.

29. The volute housing as defined in claim 17 wherein each of said fluid openings is defined by an axially inwardly directed rounded radius portion extending substantially 360 degrees which imparts a generally axially inwardly directed funnel-like configuration to each of said rounded radius portions, a relatively abrupt radius portion disposed between each of said gradually rounded radius portions and an associated inner substantially radially disposed circumferential extending wall portion, said relatively abrupt radius portions each extend circumferentially generally from said transition zone toward said volute throat, and said second sidewall portion of each sidewall includes generally radially inboard and radially outboard portions and a generally axial transition wall between each radially outboard second sidewall portion and an adjacent relatively abrupt radius portion.

30. The volute housing as defined in claim 17 wherein each innermost circumferential wall is defined by a generally inwardly opening rounded radius portion extending substantially 360° which imparts a generally axially inwardly directed funnel-like configuration to each of said rounded radius portions.

31. The volute housing as defined in claim 17 wherein said range is preferably between 25° to 200°.

32. The volute housing as defined in claim 17 wherein said range is preferably between 25° to 180°.

33. The volute housing as defined in claim 17 wherein said range is preferably between 100° to 150°.

34. The volute housing as defined in claim 17 wherein said range is preferably between 110° to 140°.

35. The volute housing as defined in claim 17 wherein said range is preferably between 125° to 135°.

36. The volute housing as defined in claim 17 wherein said range is preferably between 140° to 145°.

37. The volute housing as defined in claim 17 wherein said housing body includes a discharge opening defined by a generally polygonally contoured wall, and a peripheral outwardly directed flange adapted to engage the underside of a convector tray adjacent an air opening therethrough with which said volute housing is adapted to be associated.

38. A volute housing for a centrifugal fan, blower or the like comprising a housing body defined by opposite spaced sidewalls, a generally circular fluid inlet opening in each sidewall, said generally circular fluid inlet openings having a coincident axis, a volute peripheral wall disposed between said sidewalls and defining therewith a volute chamber, said sidewalls each having a generally minimum radial dimension located at a first zone adjacent a tongue of said volute chamber and substantially constantly progressively radially increasing to a maximum radial dimension located at a second zone adjacent a throat of said volute chamber, the arcuate distance between said first and second zones being beyond 270 degrees, said sidewalls each having a first sidewall portion extending arcuately from said first zone generally to said second zone, said first sidewall portions being in diverging relationship to each other in a direction away from said first zone toward said second zone, each second sidewall portion being defined by a substantially axially outermost wall portion disposed between said volute peripheral wall and an inner substantially radially disposed circumferential extending wall portion, each said substantially axially outermost wall portion and said inner substantially radially disposed circumferential wall portion being in substantial constantly progressive diverging relationship in a direction away from said transition zone toward said volute throat whereby fluid flowing through said housing body in a direction from said first zone toward said throat expands substantially constantly progressively axially outwardly as it flows between and along said first sidewall portions, and each of said fluid openings is defined by an axially inwardly directed rounded radius portion extending substantially 360 degrees which imparts a generally axially inwardly directed funnel-like configuration to each of said rounded radius portions.

39. The volute housing as defined in claim 38 wherein said arcuate distance between said first and second zones extends generally from said tongue to said throat.

40. The volute housing as defined in claim 38 wherein said arcuate distance between said first and second zones extends generally 360 degrees from said tongue to said throat.

41. A volute housing for a centrifugal fan, blower or the like comprising a housing body defined by opposite spaced sidewalls, a generally circular fluid inlet opening in each sidewall, said generally circular fluid inlet openings having a coincident axis, a volute peripheral wall disposed between said sidewalls and defining therewith a volute chamber, said sidewalls each having a generally minimum radial dimension located at a first zone adjacent a tongue of said volute chamber, said sidewalls each having a first sidewall portion extending arcuately from said first zone a first predetermined number of degrees less than 180 degrees to a transition zone, said first sidewall portions being in generally parallel relationship to each other between said first zone and said transition zone, said sidewalls each having a second sidewall portion extending arcuately from said transition zone generally to said volute throat, said second sidewall portions being in diverging relationship to each other in a direction away from said transition zone toward said volute throat, each second sidewall portion being defined by a substantially axially outermost wall portion disposed between said volute peripheral wall and an inner substantially radially disposed circumferential extending wall portion, and each said substantially axially outermost wall portion and said inner substantially radially disposed circumferential wall portion being in substantial constantly progressive diverging relationship in a direction away from said transition zone toward said volute throat whereby fluid flowing through said housing body in a direction from said transition zone toward said throat expands substantially constantly progressively axially outwardly as it flows between and along said second sidewall portions.

42. The volute housing as defined in claim 41 wherein said first predetermined number of degrees is at least 25 degrees but is less than 150 degrees.

43. The volute housing as defined in claim 42 wherein said first sidewall portion and said inner substantially radially disposed circumferential extending wall portions each merge with an innermost circumferential wall having a terminal edge defining each of said circular fluid inlet openings, and each of said innermost circumferential walls is directed generally axially inwardly imparting a generally axially inwardly directed funnel-like configuration to each of said circumferential walls.

44. The volute housing as defined in claim 42 wherein each of said fluid openings is defined by an axially inwardly directed rounded radius portion extending substantially 360 degrees which imparts a generally axially inwardly directed funnel-like configuration to each of said rounded radius portions, a relatively abrupt radius portion disposed between each of said gradually rounded radius portions and an associated inner substantially radially disposed circumferential extending wall portions, and said relatively abrupt radius portions each extend circumferentially generally from said transition zone toward said volute throat.

45. The volute housing as defined in claim 41 wherein said first predetermined number of degrees is substantially 135 degrees.

46. The volute housing as defined in claim 43 wherein said first predetermined number of degrees is at least 125 degrees but less than 140 degrees.

47. The volute housing as defined in claim 43 wherein said first predetermined number of degrees is at least 130 degrees but less than 140 degrees.

48. A volute housing for a centrifugal fan, blower or the like comprising a housing body defined by opposite spaced sidewalls, a generally circular fluid inlet opening in each sidewall, said generally circular fluid inlet openings having a coincident axis, a volute peripheral wall disposed between said sidewalls and defining therewith a volute chamber, said sidewalls each having a generally minimum radial dimension located at a first zone adjacent a tongue of said volute chamber, said sidewalls each having a first sidewall portion extending arcuately from said first zone generally in the range of between 25 degrees to 320 degrees to a transition zone, said first sidewall portions being in generally parallel relationship to each other between said first zone and said transition zone, said sidewalls each having a second sidewall portion extending arcuately from said transition zone generally to said volute throat, said second sidewall portions being in diverging relationship to each other in a direction away from said transition zone toward said volute throat, each second sidewall portion being defined by a substantially axially outermost wall portion joined by a relatively abrupt radially outermost circumferentially extending first radius portion to said volute peripheral wall, each second sidewall portion further including a radially innermost circumferentially extending second radius portion ending at an associated circular fluid inlet opening, said first radius portion being of a generally constant radius, said second radius portion being of a continuously progressively changing radius increasing in size from said transition zone toward said throat, said second radius portion being substantially gradual in its curvature as compared to said first radius portion, said substantially axially outermost wall portion and said first and second radius portions being in substantial constantly progressive diverging relationship in a direction away from said transition zone toward said volute throat whereby fluid flowing through said housing body in a direction from said transition zone toward said throat expands substantially constantly progressively axially outwardly as it flows between and along said second sidewall portions.

49. The volute housing as defined in claim 48 wherein said housing body includes an air outlet located beyond said volute throat, and said air outlet defines the largest cross-sectional area of air travel through said housing.

50. The volute housing as defined in claim 48 wherein said housing includes an air outlet located beyond said volute throat, and said air outlet is defined in part by a pair of generally spaced parallel sidewall portions which each merge with one of said second sidewall axially outermost wall portions.

51. The volute housing as defined in claim 48 wherein said housing includes an air outlet located beyond said volute throat, said air outlet is defined in part by a pair of generally spaced parallel sidewall portions which each merge with one of said second sidewall axially outermost wall portions, and said air flow expands axially only during its travel generally along said diverging second sidewall portions.

52. The volute housing as defined in claim 48 wherein said second radius portion imparts a generally funnel-like configuration to said sidewalls adjacent said circular outlet.

53. The volute housing as defined in claim 48 wherein said range is preferably between 150 degrees to 200 degrees.

54. The volute housing as defined in claim 48 wherein said range is preferably between 180 degrees and 200 degrees.

55. The volute housing as defined in claim 49 wherein said housing includes an air outlet located beyond said volute throat, and said air outlet is defined in part by a pair of generally spaced parallel sidewall portions which each merge with one of said second sidewall axially outermost wall portions.

56. The volute housing as defined in claim 50 wherein said housing includes an air outlet located beyond said volute throat, said air outlet is defined in part by a pair of generally spaced parallel sidewall portions which each merge with one of said second sidewall axially outermost wall portions, and said air flow expands axially only during its travel generally along said diverging second sidewall portions.

57. The volute housing as defined in claim 49 wherein said second radius portion imparts a generally funnel-like configuration to said sidewalls adjacent said circular outlet.

58. The volute housing as defined in claim 49 wherein said range is preferably between 150 degrees to 200 degrees.

59. The volute housing as defined in claim 49 wherein said range is preferably between 180 degrees and 200 degrees.

60. The volute housing as defined in claim 48 wherein said second radius portion imparts a generally funnel-like configuration to said sidewalls adjacent said circular outlet.

61. The volute housing as defined in claim 56 wherein said second radius portion imparts a generally funnel-like configuration to said sidewalls adjacent said circular outlet.

62. The volute housing as defined in claim 55 wherein said range is preferably between 150 degrees to 200 degrees.

63. The volute housing as defined in claim 55 wherein said range is preferably between 180 degrees and 200 degrees.

64. The volute housing as defined in claim 56 wherein said range is preferably between 150 degrees to 200 degrees.

65. The volute housing as defined in claim 56 wherein said range is preferably between 180 degrees and 200 degrees.

* * * * *